US009757006B2

(12) United States Patent
Uchiyama et al.

(10) Patent No.: US 9,757,006 B2
(45) **Date of Patent: *Sep. 12, 2017**

(54) ARTICLES FOR CLEANING A HARD SURFACE

(71) Applicant: The Procter & Gamble Company, Cincinnati, OH (US)

(72) Inventors: Hirotaka Uchiyama, Loveland, OH (US); Mimi Gizaw Daniel, Cincinnati, OH (US); Roberto Manuel Matos, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 650 days.

This patent is subject to a terminal disclaimer.

(21) Appl. No.: 14/221,310

(22) Filed: Mar. 21, 2014

(65) Prior Publication Data

US 2014/0290695 A1 Oct. 2, 2014

Related U.S. Application Data

(60) Provisional application No. 61/805,239, filed on Mar. 26, 2013.

(51) Int. Cl.
*C11D 1/14* (2006.01)
*C11D 3/43* (2006.01)
(Continued)

(52) U.S. Cl.
CPC ..... *A47L 13/17* (2013.01); *C11D 1/14* (2013.01); *C11D 1/29* (2013.01); *C11D 1/66* (2013.01);
(Continued)

(58) Field of Classification Search
CPC .... C11D 1/14; C11D 1/29; C11D 1/66; C11D 3/2075; C11D 3/2082; C11D 17/049; C11D 3/2003; C11D 3/2068; C11D 3/43
(Continued)

(56) References Cited

U.S. PATENT DOCUMENTS 5,364,551 A * 11/1994 Lentsch ..... C11D 1/94 510/100
5,948,741 A * 9/1999 Ochomogo ..... C11D 1/83 134/198
(Continued)

FOREIGN PATENT DOCUMENTS

EP 0 693 548 A1 1/1996
EP 0 812 904 A2 12/1997
(Continued)

OTHER PUBLICATIONS

International Search Report; International Application No. PCT/US2014/031386; date of mailing Jul. 16, 2014; 10 pages.
(Continued)

*Primary Examiner* — Gregory R Delcotto
(74) *Attorney, Agent, or Firm* — Larry L. Huston; Steven W. Miller

(57) ABSTRACT

Articles for cleaning debris from a hard surface are described herein, the articles include a hard surface cleaning composition which includes from about 0.1% to about 50% by weight of the composition of a detergent surfactant and a pad including a core and adapted to contact the hard surface. The core comprising up to about 50% cellulosic material. They are high sudsing, have excellent soap scum removal and hard water deposit removal properties and are easy to rinse. A sprayer, methods of use and kits are also disclosed.

16 Claims, 8 Drawing Sheets

(51) Int. Cl.

| | |
|---|---|
| ***C11D 3/44*** | (2006.01) |
| ***A47L 13/17*** | (2006.01) |
| ***C11D 3/20*** | (2006.01) |
| ***C11D 1/66*** | (2006.01) |
| ***C11D 1/29*** | (2006.01) |
| ***C11D 17/04*** | (2006.01) |
| *B08B 1/00* | (2006.01) |

(52) U.S. Cl.
CPC ..... *C11D 3/2003* (2013.01); *C11D 3/2068* (2013.01); *C11D 3/2075* (2013.01); *C11D 3/2082* (2013.01); *C11D 3/43* (2013.01); *C11D 17/049* (2013.01); *B08B 1/006* (2013.01)

(58) Field of Classification Search
USPC ..... 510/238, 421, 422, 426, 427, 428, 434, 510/477, 488, 505, 506
See application file for complete search history.

(56) References Cited

U.S. PATENT DOCUMENTS

| | | | | |
|---|---|---|---|---|
| 6,376,046 | B1 | 4/2002 | Hoshino et al. | |
| 8,927,479 | B2 * | 1/2015 | Perlas | C11D 3/30 510/238 |
| 9,127,241 | B2 * | 9/2015 | Hodge | B08B 3/02 |
| 9,206,381 | B2 * | 12/2015 | Hodge | C11D 3/3719 |
| 2002/0155772 | A1 | 10/2002 | Wong et al. | |
| 2004/0138079 | A1 * | 7/2004 | Becker | A61K 8/046 510/279 |
| 2005/0130869 | A1 | 6/2005 | Gross et al. | |
| 2005/0133174 | A1 | 6/2005 | Gorley et al. | |
| 2005/0155628 | A1 | 7/2005 | Kilkenny et al. | |
| 2005/0229344 | A1 | 10/2005 | Mittelstaedt et al. | |
| 2007/0093401 | A1 * | 4/2007 | Murthy | C11D 3/3956 510/191 |
| 2007/0225196 | A1 * | 9/2007 | Kuhlman | A61K 8/046 510/426 |
| 2011/0048718 | A1 | 3/2011 | Van Zanten et al. | |
| 2011/0146707 | A1 * | 6/2011 | Cermenati | C11D 3/2079 134/6 |
| 2011/0160116 | A1 * | 6/2011 | Mckechnie | C11D 1/66 510/362 |
| 2012/0302642 | A1 * | 11/2012 | Post | C11D 3/1266 514/574 |
| 2013/0047365 | A1 | 2/2013 | Goldwasser | |
| 2013/0284205 | A1 * | 10/2013 | Hodge | C11D 3/3719 134/6 |

FOREIGN PATENT DOCUMENTS

| | | | |
|---|---|---|---|
| WO | WO 95/03383 | A1 | 2/1995 |
| WO | WO 2007/141128 | A2 | 12/2007 |

OTHER PUBLICATIONS

International Search Report; International Application No. PCT/US2014/031387; date of mailing Jul. 30, 2014; 11 pages.

* cited by examiner

| Formulation | Dissolution rate mL/s |
|---|---|
| 1 | 2.58 |
| 2 | 1.55 |
| 3 | 1.20 |
| 4 | 1.10 |
| 5 | 0.99 |
| 6 | 0.83 |
| 7 | 0.54 |
| 8 | 0.41 |
| 9 | 0.32 |
| 10 | 0.31 |

Fig. 13

ARTICLES FOR CLEANING A HARD SURFACE

FIELD OF THE INVENTION

This invention relates to articles for cleaning a hard surface and, particularly, articles that include a hard surface cleaning composition, a dispenser containing the cleaning composition, a pad adapted to contact the hard surface and a kit for cleaning the hard surface. Such compositions typically contain detergent surfactants, solvents, builders, etc.

BACKGROUND OF THE INVENTION

The use of detergent compositions comprising organic water-soluble synthetic detergent surfactants and cleaning solvents for cleaning hard surfaces in, e.g., bathrooms is well established. Known liquid detergent compositions for this purpose comprise organic cleaning solvents, detergent surfactants, and optional detergent builders and/or abrasives.

Liquid cleaning compositions are usually preferred, since they have the advantage that they can be applied to hard surfaces in neat or concentrated form so that a relatively high level of, e.g., surfactant material and/or organic solvent is delivered directly to the soil. However, solid compositions can also be used to form a cleaning solution when diluted with water. Concentrated liquid cleaning compositions have the potential to provide superior soap scum, grease, and oily soil removal as compared to dilute wash solutions, e.g., those typically prepared from powdered cleaning compositions.

Furthermore, the use of articles comprising cleaning pads and a dispenser for cleaning hard surfaces are also well established. Known articles may be handheld or deployed on the end of an elongate handle, to extend the user's reach. The head of the device may include bristles, sponge, microfiber nonwoven, terry cloth, nonwoven, foam and other cleaning materials, as are known in the art.

The present invention provides preferred articles for cleaning a hard surface that include a hard surface cleaning compositions, preferably liquid, a pad and, optionally, a dispenser which are suitable for removal of soils commonly encountered on a hard surface, preferably in a bathroom, said compositions having specific surfactants, optional solvents, and, optionally, but preferably, organic acids. These articles remove soap scum and hard water marks. The articles can have disinfectant properties achieved through the choice of compositions that include antibacterial actives, including citric acid, and can be used with, or without, additives such as hydrogen peroxide and metallic ions such as silver and copper ions for additional mold/mildew prevention benefits. Further, the articles can include compositions which can advantageously incorporate one or more hydrophilic polymers for viscosity and/or improved surface wetting and/or filming/streaking properties.

SUMMARY OF THE INVENTION

The present invention, in one embodiment, relates to a hard surface cleaning composition which comprises from about 0.1% to about 50% by weight of the composition of a surfactant and a pad comprising a core and adapted to contact the hard surface. The core comprising up to about 50% cellulosic material.

In another embodiment, the present invention relates to a process of cleaning a surface comprising applying an effective amount of a composition to the surface and wiping the surface with a pad comprising a core and adapted to contact the hard surface, the core comprising up to about 50% cellulosic material. The composition comprises a hard surface cleaning composition which comprises from about 0.1% to about 50% by weight of the composition of a surfactant.

The present invention further encompasses an article for cleaning debris from a hard surface, the article comprising a hard surface cleaning composition having a suds dissolution rate from about 0.8 ml/s to about 2.6 ml/s using the Suds Dissolution Rate Test, a pad capable of generating suds in under about 50 strokes using the Suds Generation Value Test, and a dispenser capable of providing droplets with a particle size distribution at Dv50 of at least about 200 μm using the Particle Size Distribution Test Method.

In preferred one embodiment, the improved cleaning is a direct result of the selection of a $C_8$ alkyl sulfate surfactant and a pad comprising a core with up to about 50% cellulosic material.

BRIEF DESCRIPTION OF THE DRAWINGS

FIG. 13 is a graphical representation of suds dissolution, as measured by the Suds Dissolution Rate Test, using cleaning solutions of the claimed invention.

DETAILED DESCRIPTION OF THE INVENTION

Figure 1:
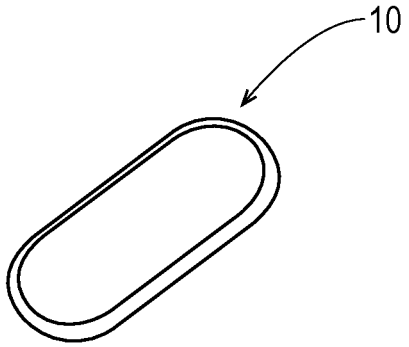
FIG. 1 is a perspective view of a pad according to the present invention.

The components of the invention disclosed herein are especially useful for cleaning the hard-to-remove soils that are commonly encountered on a hard surface and, particular, in a bathroom. These include hard water stains, fatty acids, triglycerides, lipids, insoluble fatty acid soaps, and the like. The components can be used on many different surface types, such as ceramic, fiber glass, polyurethane, and plastic surfaces.

The present invention relates to articles for cleaning debris from a hard surface comprising a surfactant and a pad, as described in further detail herein. Furthermore, the present invention also relates to processes for cleaning a hard surface comprising a surfactant and a pad.

Surfactant

Surfactants may be desired herein as they contribute to the cleaning performance of the cleaning compositions of the present invention. Suitable surfactants are selected from the group consisting of a nonionic surfactant or a mixture thereof; an anionic surfactant or a mixture thereof; an amphoteric surfactant or a mixture thereof; a zwitterionic surfactant or a mixture thereof; a cationic surfactant or a mixture thereof; and mixtures thereof.

In the preferred embodiment wherein the composition is a hard surface cleaning composition, the composition comprises from about 0.1% to about 50%, preferably from about 0.1% to about 30%, and more preferably from about 0.1% to about 10% by weight of the total composition of a surfactant.

Anionic Surfactant

Suitable anionic surfactants for use in the cleaning composition can be a sulfate, a sulfosuccinate, a sulfoacetate, and/or a sulphonate; preferably an alkyl sulfate and/or an alkyl ethoxy sulfate; more preferably a combination of an alkyl sulfate and/or an alkyl ethoxy sulfate with a combined ethoxylation degree less than about 5, preferably less than about 3, more preferably less than about 2.

Sulphate or sulphonate surfactant is typically present at a level of from about 0.1% to about 50%, preferably from about 0.1% to about 30%, and more preferably from about 0.1% to about 10% by weight of the cleaning composition.

Suitable sulphate or sulphonate surfactants for use in the photocatalyzable composition include water-soluble salts or acids of $C_8$-$C_{14}$ alkyl or hydroxyalkyl, sulphate or sulphonates. Suitable counterions include hydrogen, alkali metal cation or ammonium or substituted ammonium, but preferably sodium. Where the hydrocarbyl chain is branched, it preferably comprises a $C_{1-4}$ alkyl branching unit. The average percentage branching of the sulphate or sulphonate surfactant is preferably greater than about 30%, more preferably from about 35% to about 80%, and most preferably from about 40% to about 60% of the total hydrocarbyl chain. One particularly suitable linear alkyl sulphonate includes $C_8$ sulphonate like Witconate NAS 8® commercially available from Witco.

The sulphate or sulphonate surfactants may be selected from a $C_{11}$-$C_{18}$ alkyl benzene sulphonate (LAS), a $C_8$-$C_{20}$ primary, a branched-chain and random alkyl sulphate (AS); a $C_{10}$-$C_{18}$ secondary (2,3) alkyl sulphate; a $C_{10}$-$C_{18}$ alkyl alkoxy sulphate ($AE_xS$) wherein preferably x is from 1-30; a $C_{10}$-$C_{18}$ alkyl alkoxy carboxylate preferably comprising about 1-5 ethoxy units; a mid-chain branched alkyl sulphate as discussed in U.S. Pat. No. 6,020,303 and U.S. Pat. No. 6,060,443; a mid-chain branched alkyl alkoxy sulphate as discussed in U.S. Pat. No. 6,008,181 and U.S. Pat. No. 6,020,303; a modified alkylbenzene sulphonate (MLAS) as discussed in WO 99/05243, WO 99/05242, WO 99/05244, WO 99/05082, WO 99/05084, WO 99/05241, WO 99/07656, WO 00/23549, and WO 00/23548; a methyl ester sulphonate (MES); and an alpha-olefin sulphonate (AOS).

The paraffin sulphonate may be monosulphonate or disulphonate and usually are mixtures thereof, obtained by sulphonating a paraffin of about 10 to about 20 carbon atoms. Preferred sulphonates are those of $C_{12-18}$ carbon atoms chains and more preferably they are $C_{14-17}$ chains. Paraffin sulphonates that have the sulphonate group(s) distributed along the paraffin chain are described in U.S. Pat. No. 2,503,280; U.S. Pat. No. 2,507,088; U.S. Pat. No. 3,260,744; and U.S. Pat. No. 3,372,188.

Also suitable are the alkyl glyceryl sulphonate surfactant and/or alkyl glyceryl sulphate surfactant described in the Procter & Gamble patent application WO06/014740: A mixture of oligomeric alkyl glyceryl sulphonate and/or sulfate surfactant selected from a dimmer or a mixture thereof; a trimer or a mixture thereof; a tetramer or a mixture thereof; a pentamer or a mixture thereof; a hexamer or a mixture thereof; a heptamer or a mixture thereof; and mixtures thereof; wherein the alkyl glyceryl sulphonate and/or sulfate surfactant mixture comprises from about 0% to about 60% by weight of the monomers.

Other suitable anionic surfactants are alkyl, preferably dialkyl sulfosuccinate and/or sulfoacetate. The dialkyl sulfosuccinate may be a $C_{6-15}$ linear or branched dialkyl sulfosuccinate. The alkyl moiety may be symmetrical (i.e., the same alkyl moieties) or asymmetrical (i.e., different alkyl moieties). Preferably, the alkyl moiety is symmetrical.

Most common branched anionic alkyl ether sulphates are obtained via sulfation of a mixture of the branched alcohols and the branched alcohol ethoxylates. Also suitable are the sulfated fatty alcohols originating from the Fischer & Tropsh reaction comprising up to about 50% branching (about 40% methyl (mono or bi) about 10% cyclohexyl) such as those produced from the safol alcohols from Sasol; sulfated fatty alcohols originating from the oxo reaction wherein at least about 50% by weight of the alcohol is $C_2$ isomer (methyl to pentyl) such as those produced from the Isalchem® alcohols or Lial® alcohols from Sasol; the sulfated fatty alcohols originating from the modified oxo reaction wherein at least about 15% by weight of the alcohol is $C_2$ isomer (methyl to pentyl) such as those produced from the Neodol® alcohols from Shell.

In one particularly preferred embodiment, the surfactant is a $C_8$ alkyl sulfate. Such surfactants provide considerable performance and/or cost advantages versus other anionic surfactants. Suitable alkyl sulfates can be neutralized with an alkali metal base, preferably lithium, sodium, and/or potassium hydroxides, or can alternatively be neutralized with an ammonium or $C_1$-$C_9$ ammonium salt derivative such as mono-, di-, and/or tri-ethanol amine, diethylamine, tri-isopropanol amine, etc. wherein the nitrogen atom has from one to three substituents selected from alkyl and hydroxyalkyl groups containing from one to about four carbon atoms. The alkyl sulfates can be produced via any suitable process. Such surfactants are commercially available from several suppliers globally, including Witco Corporation (One American Lane, Greenwich, Conn. 06831), Stepan Company (Edens & Witnetka Rd, Northfield, Ill. 60093) and Imperial Chemical Industries (Concord Plaza, 3411 Silverside Rd PO Box 15391, Wilmington, Del. 19850-5391).

The usage detergent compositions according to the present invention are prepared with relatively low levels of active. Typically, compositions will comprise sufficient surfactant and optional solvent, as discussed hereinafter, to be effective as hard surface cleaners yet remain economical; accordingly they typically contain from about 0.5% to about 10% $C_8$ alkyl sulfate surfactant, more preferably from about 1% to about 6% $C_8$ alkyl sulfate surfactant, and even more preferably from about 2% to about 5% $C_8$ alkyl sulfate surfactant. It has been found that low levels of $C_8$ alkyl sulfate surfactant can be advantageous to overall cleaning performance. In the context of thickened compositions the alkyl sulfate surfactant also helps provide improved phase stability.

The alkyl sulfates of the invention have a chain length average of about 8 carbon atoms. The chain length distribution can vary from about 6 carbon atoms to about 12 carbons. However, the preferred alkyl sulfates are those that contain mostly $C_8$ alkyl sulfates. In one preferred embodiment, the alkyl group of the alkyl sulfate detergent surfactant contains about 8 carbon atoms on the average, with substantially all of the alkyl groups having within two carbon atoms of the 8 average carbon atoms. In another preferred embodiment, the cleaning composition does not include an alkyl sulfate detergent surfactant that contains about 10 carbon atoms on the average, with substantially all of the alkyl groups having within two carbon atoms of the 10 average carbon atoms.

Ammonium and sodium salts of $C_8$ alkyl sulfates are most preferred in the context of the present invention. Examples of particularly preferred, commercially available sodium $C_8$ alkyl sulfates include Stephanol $C_8$ Sulfate from Stepan Company. Alternatively, the desired $C_8$ alkyl sulfate surfactant can be produced in-situ by neutralization of the corresponding $C_8$ alkyl sulfuric acid.

Nonionic Surfactant

In one preferred embodiment, the cleaning composition comprises a nonionic surfactant. Suitable nonionic surfactants may be alkoxylated alcohol nonionic surfactants, which can be readily made by condensation processes which are well-known in the art. However, a great variety of such alkoxylated alcohols, especially ethoxylated and/or propoxylated alcohols, are commercially available. Surfactant catalogs are available which list a number of such surfactants, including nonionics.

Accordingly, preferred alkoxylated alcohols for use herein are nonionic surfactants according to the formula $R^1O(E)_e(P)_pH$ where $R^1$ is a hydrocarbon chain of from about 2 to about 24 carbon atoms, E is ethylene oxide, P is propylene oxide, and e and p which represent the average degree of, respectively ethoxylation and propoxylation, are of from about 0 to about 24 (with the sum of e+p being at least 1). Preferably, the hydrophobic moiety of the nonionic compound can be a primary or secondary, straight or branched alcohol having from about 8 to about 24 carbon atoms.

In some embodiments, preferred nonionic surfactants are the condensation products of ethylene oxide and/or propylene oxide with an alcohol having a straight or branched alkyl chain, having from about 6 to about 22 carbon atoms, preferably from about 9 to about 15 carbon atoms, wherein the degree of alkoxylation (ethoxylation and/or propoxylation) is from about 1 to about 25, preferably from about 2 to about 18, and more preferably from about 5 to about 12 moles of alkylene oxide per mole of alcohol. Particularly preferred are such surfactants containing from about 5 to about 12 moles of ethylene oxide per mole of alcohol. Such suitable nonionic surfactants are commercially available from Shell, for instance, under the trade name Neodol® or from BASF under the trade name Lutensol®.

Preferably, the nonionic surfactant is comprised in a typical amount of at a level of from about 0.1% to about 50%, preferably from about 0.1% to about 30%, and more preferably from about 0.1% to about 10% by weight of the cleaning composition.

Also suitable are alkylpolyglycosides having the formula $R^3O(C_nH_{2n}O)_t(\text{glycosyl})_z$ (formula (III)), wherein $R^3$ of formula (III) is selected from the group consisting of an alkyl or a mixture thereof; an alkyl-phenyl or a mixture thereof; a hydroxyalkyl or a mixture thereof; a hydroxyalkylphenyl or a mixture thereof; and mixtures thereof, in which the alkyl group contains from about 10 to about 18, preferably from about 12 to about 14 carbon atoms; n of formula (III) is about 2 or about 3, preferably about 2; t of formula (III) is from about 0 to about 10, preferably about 0; and z of formula (III) is from about 1.3 to about 10, preferably from about 1.3 to about 3, most preferably from about 1.3 to about 2.7. The glycosyl is preferably derived from glucose. Also suitable are alkyl glycerol ether and sorbitan ester.

Also suitable is fatty acid amide surfactant having the formula (IV):

$$R^6\overset{\overset{\displaystyle O}{\|}}{C}N(R^7)_2 \qquad \text{(IV)}$$

wherein $R^6$ of formula (IV) is an alkyl group containing from about 7 to about 21, preferably from about 9 to about 17, carbon atoms, and each $R^7$ of formula (IV) is selected from the group consisting of hydrogen; a $C_1$-$C_4$ alkyl or a mixture thereof; a $C_1$-$C_4$ hydroxyalkyl or a mixture thereof; and a —$(C_2H_4O)_yH$ or a mixture thereof, where y of formula (IV) varies from about 1 to about 3. Preferred amide can be a $C_8$-$C_{20}$ ammonia amide, a monoethanolamide, a diethanolamide, and an isopropanolamide.

Other preferred nonionic surfactants for use in the photocatalyzable composition may be the mixture of nonyl ($C_9$), decyl ($C_{10}$) undecyl ($C_{11}$) alcohols modified with, on average, about 5 ethylene oxide (EO) units such as the commercially available Neodol 91-5® or the Neodol 91-8® that is modified with on average about 8 EO units. Also suitable are the longer alkyl chains ethoxylated nonionics such as $C_{12}$ or $C_{13}$ modified with 5 EO (Neodol 23-50). Neodol® is a Shell tradename. Also suitable is the $C_{12}$ or $C_{14}$ alkyl chain with 7 EO, commercially available under the trade name Novel 1412-7® (Sasol) or the Lutensol A 7 N® (BASF).

Preferred branched nonionic surfactants are the Guerbet $C_{10}$ alcohol ethoxylates with 5 EO such as Ethylan 1005, Lutensol XP 50® and the Guerbet $C_{10}$ alcohol alkoxylated nonionics (modified with EO and PO (propylene oxide)) such as the commercially available Lutensol XL® series (X150, XL70, etc). Other branching also includes oxo branched nonionic surfactants such as the Lutensol ON 50® (5 EO) and Lutensol ON70® (7 EO). Other suitable branched nonionics are the ones derived from the isotridecyl alcohol and modified with ethylene oxide such as the Lutensol TO7® (7EO) from BASF and the Marlipal O 13/70® (7 EO) from Sasol. Also suitable are the ethoxylated fatty alcohols originating from the Fisher & Tropsch reaction comprising up to about 50% branching (about 40% methyl (mono or bi) about 10% cyclohexyl) such as those produced from the Safol® alcohols from Sasol; ethoxylated fatty alcohols originating from the oxo reaction wherein at least 50 wt % of the alcohol is $C_2$ isomer (methyl to pentyl) such as those produced from the Isalchem® alcohols or Lial® alcohols from Sasol; the ethoxylated fatty alcohols originating from the modified oxo reaction wherein at least about 15% by weight of the alcohol is $C_2$ isomer (methyl to pentyl) such as those produced from the Neodol® alcohols from Shell.

In one preferred embodiment, the weight ratio of total surfactant to nonionic surfactant is from about 2 to about 10, preferably from about 2 to about 7.5, more preferably from about 2 to about 6.

Zwitterionic Surfactant and Amphoteric Surfactant

The zwitterionic and amphoteric surfactants for use in the cleaning composition can be comprised at a level of at a level of from about 0.1% to about 50%, preferably from about 0.1% to about 30%, and more preferably from about 0.1% to about 10% by weight of the cleaning composition.

Suitable zwitterionic surfactant in the preferred embodiment wherein contains both basic and acidic groups which form an inner salt giving both cationic and anionic hydrophilic groups on the same molecule at a relatively wide range of pH's. The typical cationic group is a quaternary ammonium group, although other positively charged groups like phosphonium, imidazolium and sulfonium groups can be used. The typical anionic hydrophilic groups are carboxylate and sulphonate, although other groups like sulfate, phosphonate, and the like can be used.

The cleaning composition may preferably further comprise an amine oxide and/or a betaine. Most preferred amine oxides are coconut dimethyl amine oxide or coconut amido propyl dimethyl amine oxide. Amine oxide may have a linear or mid-branched alkyl moiety. Typical linear amine oxides include water-soluble amine oxide containing one $R^4$ $C_{8-18}$ alkyl moiety and 2 $R^5$ and $R^8$ moieties selected from the group consisting of a $C_{1-3}$ alkyl group and a mixtures thereof; and a $C_{1-3}$ hydroxyalkyl group and a mixture thereof. Preferably amine oxide is characterized by the formula $R^4—N(R^5)(R^8)\rightarrow O$ wherein $R^4$ is a $C_{8-18}$ alkyl and $R^5$ and $R^8$ are selected from the group consisting of a methyl; an ethyl; a propyl; an isopropyl; a 2-hydroxethyl; a 2-hydroxypropyl; and a 3-hydroxypropyl. The linear amine oxide surfactant, in particular, may include a linear $C_{10}$-$C_{18}$ alkyl dimethyl amine oxide and a linear $C_8$-$C_{12}$ alkoxy ethyl dihydroxy ethyl amine oxide. Preferred amine oxides include linear $C_{10}$, linear $C_{10}$-$C_{12}$, and linear $C_{12}$-$C_{14}$ alkyl dimethyl amine oxides.

As used herein "mid-branched" means that the amine oxide has one alkyl moiety having $n_1$ carbon atoms with one alkyl branch on the alkyl moiety having $n_2$ carbon atoms. The alkyl branch is located on the a carbon from the nitrogen on the alkyl moiety. This type of branching for the amine oxide is also known in the art as an internal amine oxide. The total sum of $n_1$ and $n_2$ is from about 10 to about 24 carbon atoms, preferably from about 12 to about 20, and more preferably from about 10 to about 16. The number of carbon atoms for the one alkyl moiety ($n_1$) should be approximately the same number of carbon atoms as the one alkyl branch ($n_2$) such that the one alkyl moiety and the one alkyl branch are symmetric. As used herein, "symmetric" means that $|n_1-n_2|$ is less than or equal to about 5, preferably about 4, most preferably from about 0 to about 4 carbon atoms in at least about 50 wt %, more preferably at least about 75 wt % to about 100 wt % of the mid-branched amine oxide for use herein.

The amine oxide further comprises two moieties, independently selected from a $C_{1-3}$ alkyl; a $C_{1-3}$ hydroxyalkyl group; or a polyethylene oxide group containing an average of from about 1 to about 3 ethylene oxide groups. Preferably the two moieties are selected from a $C_{1-3}$ alkyl, more preferably both are selected as a $C_1$ alkyl.

Other suitable surfactants include a betaine such an alkyl betaine, an alkylamidobetaine, an amidazoliniumbetaine, a sulfobetaine (INCI Sultaines), as well as a phosphobetaine, and preferably meets formula I:

$$R^{1'}—[CO—X(CH_2)_j]_g—N^+(R^{2'})(R^{3'})—(CH_2)_f—[CH(OH)—CH_2]_h—Y— \quad \text{(I) wherein}$$

$R^{1'}$ is a saturated or unsaturated $C_{6-22}$ alkyl residue, preferably a $C_{8-18}$ alkyl residue, in particular a saturated $C_{10-16}$ alkyl residue, for example a saturated $C_{12-14}$ alkyl residue;

X is NH, $NR^{4'}$ with $C_{1-4}$ alkyl residue $R^{4'}$, O or S, j is a number from about 1 to about 10, preferably from about 2 to about 5, in particular about 3, g is about 0 or about 1, preferably about 1, $R^{2'}$, $R^{3'}$ are independently a $C_{1-4}$ alkyl residue, potentially hydroxy substituted by such as a hydroxyethyl, preferably by a methyl.

f is a number from about 1 to about 4, in particular about 1, 2 or 3, h is about 0 or 1, and Y is selected from COO, $SO_3$, $OPO(OR^{5'})O$ or $P(O)(OR^{5'})O$, whereby $R^{5'}$ is a hydrogen atom H or a $C_{1-4}$ alkyl residue.

Preferred betaines are the alkyl betaine of the formula ($I_a$), the alkyl amido betaine of the formula ($I_b$), the sulfo betaine of the formula ($I_c$), and the Amido sulfobetaine of the formula ($I_d$);

$$R^{1'}—N^+(CH_3)_2—CH_2COO^- \quad (I_a)$$

$$R^{1'}—CO—NH(CH_2)_3—N^+(CH_3)_2—CH_2COO^- \quad (I_b)$$

$$R^{1'}—N^+(CH_3)_2—CH_2CH(OH)CH_2SO_3— \quad (I_c)$$

$$R^{1'}—CO—NH—(CH_2)_3—N^+(CH_3)_2—CH_2CH(OH)CH_2SO_3^- \quad (I_d)$$

in which $R^{1'}$ has the same meaning as in formula I. Particularly preferred betaines are the carbobetaine, wherein $Y^-$ is $[COO^-]$, in particular the carbobetaine of formula ($I_a$) and ($I_b$), more preferred are the alkylamidobetaine of the formula ($I_b$).

Examples of suitable betaines and sulfobetaines are the following (designated in accordance with INCI): almondamidopropyl of betaine, apricotamidopropyl betaine, avocadamidopropyl of betaine, babassuamidopropyl of betaine, behenamidopropyl betaine, behenyl of betaine, betaine, canolamidopropyl betaine, capryl/capramidopropyl betaine, carnitine, cetyl of betaine, cocamidoethyl of betaine, cocamidopropyl betaine, cocamidopropyl hydroxysultaine, coco betaine, coco hydroxysultaine, coco/oleamidopropyl betaine, coco sultaine, decyl of betaine, dihydroxyethyl oleyl glycinate, dihydroxyethyl soy glycinate, dihydroxyethyl stearyl glycinate, dihydroxyethyl tallow glycinate, dimethicone propyl of PG-betaine, drucamidopropyl hydroxysultaine, hydrogenated tallow of betaine, isostearamidopropyl betaine, lauramidopropyl betaine, lauryl of betaine, lauryl hydroxysultaine, lauryl sultaine, milk amidopropyl betaine, milkamidopropyl of betaine, myristamidopropyl betaine, myristyl of betaine, oleamidopropyl betaine, oleamidopropyl hydroxysultaine, oleyl of betaine, olivamidopropyl of betaine, palmamidopropyl betaine, palmitamidopropyl betaine, palmitoyl carnitine, palm kernel amidopropyl betaine, polytetrafluoroethylene acetoxypropyl of betaine, ricinoleamidopropyl betaine, sesamidopropyl betaine, soyamidopropyl betaine, stearamidopropyl betaine, stearyl of betaine, tallowamidopropyl betaine, tallowamidopropyl hydroxysultaine, tallow of betaine, tallow dihydroxyethyl of betaine, undecylenamidopropyl betaine and wheat germ amidopropyl betaine. Preferred betaine is for example cocoamidopropyl betaine.

For example coconut dimethyl betaine is commercially available from Seppic under the trade name of Amonyl 265®. Lauryl betaine is commercially available from Albright & Wilson under the trade name Empigen BB/L®. A further example of betaine is lauryl-imino-dipropionate commercially available from Rhodia under the trade name Mirataine H2C-HA®.

One particularly preferred zwitterionic surfactants for use in the preferred embodiment wherein the composition is a hard surface cleaning composition is the sulfobetaine surfactant, because it delivers optimum soap scum cleaning benefits.

Examples of particularly suitable sulfobetaine surfactants include tallow bis(hydroxyethyl) sulphobetaine and cocoamido propyl hydroxy sulphobetaine which are commercially available from Rhodia and Witco, under the trade name of Mirataine CBS® and Rewoteric AM CAS 15® respectively.

Cationic Surfactant

In one preferred embodiment, the cleaning composition can comprise a cationic surfactant present in an effective amount, more preferably at a level of from about 0.1% to about 50%, preferably from about 0.1% to about 30%, and more preferably from about 0.1% to about 10% by weight of the cleaning composition. Suitable cationic surfactant is quaternary ammonium surfactant. Suitable quaternary ammonium surfactant is selected from the group consisting of a mono $C_6$-$C_{16}$, preferably a $C_6$-$C_{10}$ N-alkyl or an alkenyl ammonium surfactant or a mixture thereof, wherein the remaining N positions are substituted by a methyl, a hydroxyethyl or a hydroxypropyl group. Another preferred cationic surfactant is a $C_6$-$C_{18}$ alkyl or alkenyl ester of a quaternary ammonium alcohol, such as quaternary chlorine ester. More preferably, the cationic surfactant has formula (V):

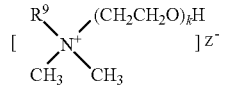

(V)

wherein $R^9$ of formula (V) is a $C_8$-$C_{18}$ hydrocarbyl or a mixture thereof, preferably, a $C_{8-14}$ alkyl, more preferably, a $C_8$, $C_{10}$ or $C_{12}$ alkyl; and Z of formula (V) is an anion, preferably, a chloride or a bromide.

The Optional Organic Cleaning Solvent

The compositions, optionally, can also contain one, or more, organic cleaning solvents at effective levels, typically no less than about 0.5%, and, at least about, in increasing order of preference, about 1% and about 2%, and no more than about, in increasing order of preference, about 8% and about 6% by weight of the composition.

The articles which include the essential $C_8$ alkyl sulfate surfactant provide exceptional cleaning even when there is no hydrophobic cleaning solvent present. However, the good cleaning can normally be further improved by the use of the right organic cleaning solvent. By organic cleaning solvent, it is meant an agent which assists the surfactant to remove soils such as those commonly encountered in the bathroom. The organic cleaning solvent also can participate in the building of viscosity, if needed, and in increasing the stability of the composition. The compositions containing $C_8$ alkyl sulfates also have lower sudsing characteristics when the solvent is present. Thus, the suds profile can be controlled in large part by simply controlling the level of hydrophobic organic cleaning solvent in the formulation. Additionally, it is found that organic solvents facilitate the rinsing of compositions comprising $C_8$AS. It is believed that the rinse benefits follow from lower suds level and that organic solvents suppress suds in an analogous manner to silicone oils, by occupying sites at the air-water interface while not being surface active. Thus, more hydrophobic solvents such as dipropylene glycol butyl ether are stronger suds suppressors than less hydrophobic solvents such as propylene glycol butyl ether.

Such solvents typically have a terminal $C_3$-$C_6$ hydrocarbon attached to from one to three ethylene glycol or propylene glycol moieties to provide the appropriate degree of hydrophobicity and, preferably, surface activity. Examples of commercially available hydrophobic cleaning solvents based on ethylene glycol chemistry include mono-ethylene glycol n-hexyl ether (Hexyl Cellosolve® available from Dow Chemical). Examples of commercially available hydrophobic cleaning solvents based on propylene glycol chemistry include the di-, and tri-propylene glycol derivatives of propyl and butyl alcohol, which are available from Arco Chemical, 3801 West Chester Pike, Newtown Square, Pa. 19073) and Dow Chemical (1691 N. Swede Road, Midland, Mich.) under the trade names Arcosolv® and Dowanol®.

In the context of the present invention, preferred solvents are selected from the group consisting of mono-propylene glycol mono-propyl ether, mono-propylene glycol mono-butyl ether di-propylene glycol mono-propyl ether, di-propylene glycol mono-butyl ether; tri-propylene glycol mono-butyl ether; ethylene glycol mono-butyl ether; di-ethylene glycol mono-butyl ether, ethylene glycol mono-hexyl ether and di-ethylene glycol mono-hexyl ether, and mixtures thereof. "Butyl" includes both normal butyl, isobutyl and tertiary butyl groups. Di-propylene glycol mono-butyl ether is most preferred cleaning solvent and is available under the trade names Arcosolv DPnB® and Dowanol DPnB®. Di-propylene glycol mono-t-butyl ether is commercially available from Arco Chemical under the tradename Arcosolv PTB®.

The amount of organic cleaning solvent can vary depending on the amount of other ingredients present in the composition. The hydrophobic cleaning solvent is normally helpful in providing good cleaning.

The Optional pH Adjustment Agent

Alkaline Material

Preferably, an alkaline material may be present to trim the pH and/or maintain the pH of the composition according to the present invention. The amount of alkaline material is from about 0.001% to about 20%, preferably from about 0.01% to about 10%, and more preferably from about 0.05% to about 3% by weight of the composition. In such embodiments, the compositions are basic with a pH of from about 7 to about 14, more preferably about 9 to about 12, and more preferably about 10 to about 11.

Examples of the alkaline material are sodium hydroxide, potassium hydroxide and/or lithium hydroxide, and/or the alkali metal oxide, such as sodium and/or potassium oxide, or mixtures thereof. Preferably, the source of alkalinity is sodium hydroxide or potassium hydroxide, preferably sodium hydroxide.

Acid

The cleaning composition of the present invention may comprise an acid. Any acid known to those skilled in the art may be used herein. Typically the composition herein may comprise up to about 20%, preferably from about 0.1% to about 10%, more preferably from about 0.1% to about 7.5%, even more preferably from about 0.1% to about 5%, by weight of the total composition of an acid.

In preferred embodiments, the compositions are acidic with a pH of from about 2 to about 7, more preferably about 3 to about 6, and more preferably about 3.5 to about 5.5. Acidity can be accomplished, at least in part, through the use of one or more organic acids that have a pKa of less than about 5, preferably less than about 4. Such organic acids also can assist in phase formation for thickening, if needed, as well as provide hard water stain removal properties. It is found that organic acids are very efficient in promoting good hard water removal properties within the framework of the compositions of the present invention. Lower pH and use of one or more suitable acids is also found to be advantageous for disinfectancy benefits.

Suitable acids are selected from the group consisting of a mono- and poly-carboxylic acid or a mixture thereof; a percarboxylic acid or a mixture thereof; a substituted carboxylic acid or a mixture thereof; and mixtures thereof. Carboxylic acids useful herein include $C_{1-6}$ linear or at least about 3 carbon containing cyclic acids. The linear or cyclic carbon-containing chain of the carboxylic acid may be substituted with a substituent group selected from the group consisting of hydroxyl, ester, ether, aliphatic groups having from about 1 to about 6, more preferably from about 1 to about 4 carbon atoms, and mixtures thereof.

Examples of suitable mono-carboxylic acids including acetic acid, glycolic acid, lactic acid or β-hydroxy propionic acid and the like. Examples of suitable polycarboxylic acids include citric acid, tartaric acid, succinic acid, glutaric acid, adipic acid, and mixtures thereof. Such acids are readily available in the trade. Examples of more preferred polycarboxylic acids include citric acid (available from Aldrich Corporation, 1001 West Saint Paul Avenue, Milwaukee, Wis.) and a mixture of succinic, glutaric and adipic acids available from DuPont (Wilmington, Del.) sold as "refined AGS di-basic acids". Citric acid is most preferred, particularly for cleaning soap scum. Glycolic acid and the mixture of adipic, glutaric and succinic acids provide greater benefits for hard water stain removal.

Suitable percarboxylic acids are selected from the group consisting of peracetic acid, percarbonic acid, perboric acid, and mixtures thereof.

Suitable substituted carboxylic acids are selected from the group consisting of an amino acid or a mixture thereof; a halogenated carboxylic acid or a mixture thereof; and mixtures thereof.

Preferred acids for use herein are selected from the group consisting of lactic acid, citric acid, and ascorbic acid and mixtures thereof. More preferred acids for use herein are selected from the group consisting of lactic acid and citric acid and mixtures thereof. An even more preferred acid for use herein is lactic acid.

Suitable acids are commercially available from JBL, T&L, or Sigma. Lactic acid is commercially available from Sigma and Purac.

The amount of acid in the compositions herein can be from about 1% to about 10%, more preferably from about 2% to about 8%, most preferably from about 3% to about 6% by weight of the composition.

Optional Source of Peroxide:

The compositions of the invention can contain peroxide such as hydrogen peroxide, or a source of hydrogen peroxide, for further disinfectancy, fungistatic and fungicidal benefits. Peroxide is believed to enhance the longevity of the benefit because of its well known residuality and slow decomposition to produce free radical species. The components of the present composition are substantially compatible with the use of peroxides. Preferred peroxides include benzoyl peroxide and hydrogen peroxide. These can optionally be present in the compositions herein in levels of from about 0.05% to about 5%, more preferably from about 0.1% to about 3%, most preferably from about 0.2% to about 1.5%.

When peroxide is present, it is desirable to provide a stabilizing system. Suitable stabilizing systems are known. A preferred stabilizing system consists of radical scavengers and/or metal chelants present at levels of from about 0.01% to about 0.5%, more preferably from about 0.01% to about 0.25%, most preferably from about 0.01% to about 0.10%, by weight of the composition. Examples of radical scavengers include anti-oxidants such as propyl gallate, butylated hydroxy toluene (BHT), butylated hydroxy anisole (BHA) and the like. Examples of suitable metal chelants include diethylene triamine penta-acetate, diethylene triamine penta-methylene phosphonate, hydroxyethyl diphosphonate and the like.

Optional Quaternary Surfactant:

Incorporation of quaternary ammonium surfactants is particularly preferred for compositions intended to deliver antibacterial, fungistatic and fungicidal properties. Quaternary ammonium surfactants are known in the art and include $C_{10-16}$ alkyl trimethyl ammonium, $C_{8-14}$ dialkyl dimethyl ammonium and $C_{10-16}$ alkyl dimethylbenzyl ammonium derivatives and mixtures thereof. Suitable and commercially available $C_{10-16}$ alkyl trimethyl ammonium and $C_{8-14}$ dialkyl dimethyl ammonium quaternaries are available from Witco corporation under the tradename Adogen®; suitable $C_{10-16}$ alkyl dimethylbenzyl ammonium surfactants may be purchased from Lonza incorporated under the tradename Bardac®. Quaternary ammonium surfactants are preferably present in no greater than about 2%, more preferably no greater than about 1.5%, most preferably no greater than about 1% by weight of the composition.

Optional Thickener

The compositions of the present invention preferably have viscosity from 50 to 2000 centipoises (50-2000 mPa*s), more preferably from 100 to 1500 centipoises (100-1500 mPa*s), and most preferably from 500 to 1300 centipoises (500-1300 mPa*s) at $20^{s-1}$ and 20° C. Viscosity can be determined by conventional methods. Viscosity according to the present invention is measured using an AR 550 rheometer from TA instruments using a plate steel spindle at 40 mm diameter and a gap size of 500 μm. The high shear viscosity at $20^{s-1}$ and low shear viscosity at $0.05^{s-1}$ can be obtained from a logarithmic shear rate sweep from $0.1^{s-1}$ to $25^{s-1}$ in 3 minutes time at 20° C. The preferred rheology described therein may be achieved using internal thickeners with detergent ingredients or by employing an external thickeners. Hence, in a preferred embodiment of the present invention, the composition comprises further a thickener.

The overall objective in adding such a thickener to the compositions herein is to arrive at cleaning compositions which are suitably functional and aesthetically pleasing from the standpoint of product thickness, product pourability, product optical properties, and/or particles suspension performance. Thus the thickener will generally serve to establish appropriate rheological characteristics of the liquid product and will do so without imparting any undesirable attributes to the product such as unacceptable optical properties or unwanted phase separation.

Generally, the thickener will be comprised at a level of from 0.001% to 3% by weight, preferably from 0.01% to 2% by weight, more preferably from 0.02% to 1% by weight of the composition.

One type of thickener which is especially useful in the compositions of the present invention comprises non-polymeric (except for conventional alkoxylation), crystalline hydroxy-functional materials which can form thread-like structuring systems throughout the liquid matrix when they are crystallized within the matrix in situ. Such materials can be generally characterized as crystalline, hydroxyl-containing fatty acids, fatty esters or fatty waxes. Such materials will generally be selected from those having the following formulas:

I)

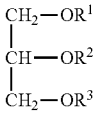

Wherein $R^1$ is the chemical moiety described below and $R^2$ is $R^1$ or H; $R^3$ is $R^1$ or H; $R^4$ is independently $C_{10}$-$C_{22}$ alkyl or alkenyl comprising at least one hydroxyl group;

$R^1$ is

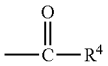

II)

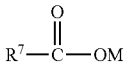

wherein: $R^7$ is the chemical moiety designed below and $R^4$ is as defined above in i); M is $Na^+$, $K^+$, $Mg^{++}$ or $Al^{3+}$, or H; and $R^7$ is

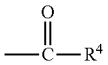

$$Z—(CH(OH))a\text{-}Z' \qquad \text{III)}$$

where a is from 2 to 4, preferably 2; Z and Z' are hydrophobic groups, especially selected from $C_6$-$C_{20}$ alkyl or cycloalkyl, $C_6$-$C_{24}$ alkaryl or aralkyl, $C_6$-$C_{20}$ aryl or mixtures thereof. Optionally Z can contain one or more nonpolar oxygen atoms as in ethers or esters.

Materials of the Formula I type are preferred. They can be more particularly defined by the following formula:

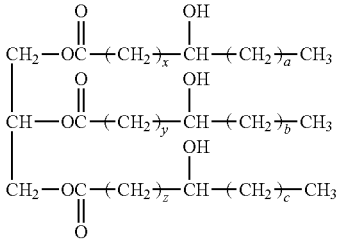

wherein:

(x+a) is from between 11 and 17;

(y+b) is from between 11 and 17; and (z+c) is from between 11 and 17.

Preferably, in this formula x=y=z=10 and/or a=b=c=5.

In a preferred embodiment, the thickener is a crystalline, hydroxyl-containing thickener such as castor oil and its derivatives. Especially preferred are hydrogenated castor oil derivatives such as hydrogenated castor oil and hydrogenated castor wax. Commercially available, castor oil-based, crystalline, hydroxyl-containing rheology modifiers include THIXCIN® from Rheox, Inc. (now Elementis).

Alternative commercially available materials that are suitable for use as crystalline, hydroxyl-containing thickeners are those of Formula III hereinbefore. An example of a thickener of this type is 1,4-di-O-benzyl-D-Threitol in the R,R, and S,S forms and any mixtures, optically active or not. These preferred crystalline, hydroxyl-containing thickeners, and their incorporation into aqueous shear-thinning matrices, are described in greater detail in U.S. Pat. No. 6,080,708 and in PCT Publication No. WO 02/40627.

Other types of thickeners, besides the non-polymeric, crystalline, hydroxyl-containing thickeners described hereinbefore, may be utilized in the cleaning compositions herein. Polymeric materials which will provide shear-thinning characteristics to the aqueous liquid matrix may also be employed.

Suitable polymeric thickeners include those of the polyacrylate, polysaccharide or polysaccharide derivative type. Polysaccharide derivatives typically used as rheology modifiers comprise polymeric gum materials. Such gums include pectine, alginate, arabinogalactan (gum Arabic), carrageenan, gellan gum, xanthan gum and guar gum. Gellan gum is commercially marketed by CP Kelco U.S., Inc. under the KELCOGEL tradename. Processes for preparing gellan gum are described in U.S. Pat. Nos. 4,326,052; 4,326,053; 4,377,636 and 4,385,123.

A further alternative and suitable thickener is a combination of a solvent and a polycarboxylate polymer. More specifically the solvent is preferably an alkylene glycol. More preferably the solvent is dipropylene glycol. Preferably the polycarboxylate polymer is a polyacrylate, polymethacrylate or mixtures thereof. The solvent is preferably present at a level of from 0.5 to 15%, preferably from 2 to 9% of the composition. The polycarboxylate polymer is preferably present at a level of from 0.1 to 10%, more preferably 2 to 5% of the composition. The solvent component preferably comprises a mixture of dipropyleneglycol and 1,2-propanediol. The ratio of dipropyleneglycol to 1,2-propanediol is preferably 3:1 to 1:3, more preferably 1:1. The polyacrylate is preferably a copolymer of unsaturated mono- or di-carbonic acid and 1-30C alkyl ester of the (meth) acrylic acid. In another preferred embodiment the thickener is a polyacrylate of unsaturated mono- or di-carbonic acid and 1-30C alkyl ester of the (meth) acrylic acid. Such copolymers are available from Noveon Inc under the tradename Carbopol Aqua 30.

Another preferred thickener for use in the present invention is Micro Fibril Cellulose (MFC) such as described in US2008/0108714: microfibrous cellulose, bacterially derived or otherwise, can be used to provide suspension of particulates in surfactant-thickened systems as well as in formulations with high surfactant concentrations. Such MFC is usually present at concentrations from about 0.01% to about 1%, but the concentration will depend on the desired product. For example, while from 0.02 to 0.05% is preferred for suspending small mica platelets in liquid detergent composition. Preferably, MFC is used with co-agents and/or co-processing agents such as CMC, xanthan, and/or guar gum with the microfibrous. US2008/0108714 describes MFC in combination with xanthan gum, and CMC in a ratio of 6:3:1, and MFC, guar gum, and CMC in a ratio of 3:1:1. These blends allow to prepare MFC as a dry product which can be "activated" with high shear or high extensional mixing into water or other water-based solutions. "Activation" occurs when the MFC blends are added to water and the co-agents/co-processing agents are hydrated. After the hydration of the co-agents/co-processing agents, high shear is generally then needed to effectively disperse the MFC to produce a three-dimensional functional network that exhibits a true yield point. Commercially available MFC: Cellulon® from CPKelko.

Optional Hydrophilic Polymer:

In a preferred embodiment, the compositions of the present invention can advantageously incorporate low levels of hydrophilic polymer. These polymers have been found to enhance water sheeting on surfaces and improve filming streaking. It is believed that such polymers hydrophilically modify ceramic surface thereby reducing water surface tension and inducing improved water sheeting on said surfaces. This sheeting effect allows for channeling of dissolved soils down shower walls in bathrooms, leading to lower residual soil levels.

Hydrophilic polymers have also been shown to mitigate the surface spotting caused by surfactants, especially for compositions that additionally include quaternary ammonium surfactant.

Preferred hydrophilic polymers to be used in conjunction with compositions of the present invention include: polystyrene sulfonate, polyvinyl pyrrolidone, polyvinyl pyrrolidone/acrylate copolymer, polyvinyl pyridine and polyvinyl pyridine n-oxide. For compositions that include optional hydrogen peroxide, the most preferred polymers are polyvinyl pyridine and polyvinyl pyridine n-oxide. The preferred polymers, if present, have an average molecular weight of from about 10,000 to about 5,000,000, more preferably from about 20,000 to about 1,000,000, most preferably from about 30,000 to about 500,000. The level of polymer desired to achieve the desired benefits is from about 0.001% to about 0.10%, more preferably from about 0.005% to about 0.075%, most preferably from about 0.01% to about 0.05%. The specific level of polymer depends on the formulator's objective. Thus, while improved sheeting results from increased level of polymer, it is also found that hard water removal performance deteriorates.

The Optional Aqueous Solvent System

The compositions which are aqueous comprise at least about 60% aqueous solvent by weight of the composition, more preferably from about 60% to about 90% by weight of the composition. The aqueous compositions typically contain the detergent surfactants in micellar form, and do not incorporate substantial levels of water insoluble components that induce significant micellar swelling; the compositions are preferably adjusted to a final pH of from about 2 to about 7, more preferably about 5.

The aqueous solvent system can also comprise low molecular weight, highly water soluble solvents typically found in detergent compositions, e.g., ethanol, isopropanol, etc.

The compositions of the present invention can also include other solvents, and in particular paraffins and isoparaffins, which can substantially reduce the suds created by the composition.

Optional Perfume and Additional Adjuvants:

Optional components, such as perfumes and other conventional adjuvants can also be present.

Perfume

An optional, but highly preferred ingredient is perfume, usually a mixture of perfume ingredients. Indeed, perfume ingredients, which are typically hydrophobic materials, have been found to provide a contribution to building viscosity, perhaps through supporting the phase structure of the product, as well as improving the overall stability of the product. As used herein, perfume includes constituents of a perfume which are added primarily for their olfactory contribution.

Most hard surface cleaner products contain some perfume to provide an olfactory aesthetic benefit and to cover any "chemical" odor that the product may have. The main function of a small fraction of the highly volatile, low boiling (having low boiling points), perfume components in these perfumes is to improve the fragrance odor of the product itself, rather than impacting on the subsequent odor of the surface being cleaned. However, some of the less volatile, high boiling perfume ingredients can provide a fresh and clean impression to the surfaces, and it is sometimes desirable that these ingredients be deposited and present on the dry surface.

The perfumes are preferably those that are more water-soluble and/or volatile to minimize spotting and filming. The perfumes useful herein are described in more detail in U.S. Pat. No. 5,108,660, Michael, issued Apr. 28, 1992, at col. 8 lines 48 to 68, and col. 9 lines 1 to 68, and col. 10 lines 1 to 24, said patent, and especially said specific portion, being incorporated by reference.

Perfume components can be natural products such as essential oils, absolutes, resinoids, resins, concretes, etc., and/or synthetic perfume components such as hydrocarbons, alcohols, aldehydes, ketones, ethers, acids, acetals, ketals, nitriles, etc., including saturated and unsaturated compounds, aliphatic, carbocyclic and heterocyclic compounds. Examples of such perfume components are: geraniol, geranyl acetate, linalool, linalyl acetate, tetrahydrolinalool, citronellol, citronellol acetate, dihydromyrcenol, dihydromyrcenyl acetate, terpineol, terpinyl acetate, acetate, 2-phenylethanol, 2-phenylethyl acetate, benzyl alcohol, benzyl acetate, benzyl salicylate, benzyl benzoate, styrallyl acetate, amyl salicylate, dimenthylbenzylcarbinol, trichloromethylphenycarbinyl acetate, p-tert.butyl-cyclohexyl acetate, isononyl acetate, alpha-n-amylcinammic aldehyde, alpha-hexyl-cinammic aldehyde, 2-methyl-3-(p-tert.butylphenyl)-propanal, 2-methyl-3 (p-isopropylphenyl)propanal, 3-(p-tert.butylphenyl)propanal, tricyclodecenyl acetate, tricyclodecenyl propionate, 4-(4-hydroxy-4-methylpentyl)-3-cyclohexenecarbaldehyde, 4-(4-methyl-3-pentenyl)-3cyclohexenecarbaldehyde, 4-acetoxy-3-pentyl-tetrahhydropyran, methyl dihydrojasmonate, 2-n-heptyl-cyclopentanone, 3-methyl-2-pentyl-cyclopentanone, n-decanal, n-dodecanal, 9-decenol-1, phenoxyethyl isobutyrate, phenylacetaldehyde dimenthyl acetal, phenylacetaldehyde dicetyll acetal, geranonitrile, citronellonitrile, cedryl acetate, 3-isocamphyl-cyclohexanol, cedryl ether, isolongifolanone, aubepine nitrile, aubepine, heliotropine, coumarin, eugenol, vanillin, diphenyl oxide, hydroxycitronellal, ionones, methyl ionones, isomethyl ionones, irones, cis-3-hexenol and esters thereof, indane musks, tetralin musks, isochroman musks, macrocyclic ketones, macrolactone musks, ethylene brassylate, aromatic nitromusk. Compositions herein typically comprise from 0.1% to 2% by weight of the total composition of a perfume ingredient, or mixtures thereof, preferably from 0.1% to 1.0%. In the case of the preferred embodiment containing peroxide, the perfumes must be chosen so as to be compatible with the oxidant.

In a preferred execution, the perfume ingredients are hydrophobic and highly volatile, e.g., ingredients having a boiling point of less than about 260° C., preferably less than about 255° C.; and more preferably less than about 250° C., and a C log P of at least about 3, preferably more than about 3.1, and even more preferably more than about 3.2.

The log P of many ingredients has been reported; for example, the Pomona92 database, available from Daylight Chemical Information Systems, Inc. (Daylight CIS), Irvine, Calif., contains many, along with citations to the original literature. However, the log P values are most conveniently calculated by the "C LOG P" program, also available from Daylight CIS. This program also lists experimental log P values when they are available in the Pomona92 database. The "calculated log P" (C log P) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each ingredient, and takes into account the numbers and types of atoms, the atom connectivity, and chemical bonding. The C log P values, which are the most reliable and widely used estimates for this physicochemical property, are preferably used instead of the experimental log P values in the selection of the principal solvent ingredients which are useful in the present invention. Other methods that can be used to compute C log P include, e.g., Crippen's fragmentation method as disclosed in J. Chem. Inf. Comput. Sci., 27, 21 (1987); Viswanadhan's fragmentation method as disclose in J. Chem. Inf. Comput. Sci., 29, 163 (1989); and Broto's method as disclosed in Eur. J. Med. Chem.-Chim. Theor., 19, 71 (1984).

The compositions herein can comprise a variety of other optional ingredients, including further actives and detergent builder, as well as mere aesthetical ingredients.

In particular the rheology of the compositions herein can be made suitable for suspending particles in the composition, e.g., particles of abrasives.

Detergent builders that are efficient for hard surface cleaners and have reduced filming/streaking characteristics at the critical levels are another optional ingredient. Preferred detergent builders are the carboxylic acid detergent builders described hereinbefore as part of the polycarboxylic acid disclosure, including citric and tartaric acids. Tartaric acid improves cleaning and can minimize the problem of filming/streaking that usually occurs when detergent builders are added to hard surface cleaners.

The detergent builder is present at levels that provide detergent building, and, those that are not part of the acid pH adjustment described hereinbefore, are typically present at a level of from about 0.1% to about 0.3%. More preferably the detergent builders are at levels from about 0.2% to about 2%, and most preferably from about 0.5 to about 1%.

The compositions herein can also contain other various adjuncts which are known to the art for detergent compositions. Preferably they are not used at levels that cause unacceptable filming/streaking.

Non-limiting examples of other adjuncts are: enzymes such as proteases; hydrotropes such as sodium toluene sulfonate, sodium cumene sulfonate and potassium xylene sulfonate; thickeners other than the hydrophilic polymers at a level of from about 0.01% to about 0.5%, preferably from about 0.05% to about 0.4%; and aesthetic-enhancing ingredients such as colorants, providing they do not adversely impact on filming/streaking.

Antibacterial agents can be present, but preferably only at levels below about 0.5%, preferably below about 0.4%, to avoid filming/streaking problems. More hydrophobic antibacterial/germicidal agents, like orthobenzyl-para-chlorophenol, are avoided. If present, such materials should preferably be kept at levels below about 0.1%.

Making Processes:

The compositions herein can be made by mixing together all ingredients. In general, a preferred order of addition is to first incorporate water, the surfactant, such as a $C_8$ alkyl sulfate detergent surfactant and, if any, organic acid, followed by any hydrophobic cleaning solvent. Once the solvent is added, pH is adjusted to optimum as desired by the formulator. Optional, peroxide, polymer, perfume and dye can then be added.

Dispenser

The article of cleaning a hard surface herein comprises, in one embodiment, the composition in a dispenser. The cleaning composition is placed into a dispenser in order to be distributed onto the surface that is to be cleaned. Said dispenser is preferably any of the manually activated means for producing a spray of liquid droplets as is known in the art, e.g. trigger-type, pump-type, non-aerosol self-pressurized, and aerosol-type spray means. The dispenser herein can include those that will or will not substantially foam the acidic cleaning composition. In one preferred embodiment, performance is increased by providing smaller particle droplets. Desirably, in this embodiment, the dispenser is capable of providing droplets with a particle size distribution at Dv50, such method described in further detail herein, of at least about 200 μm, 250 μm, 300 μm, 400 μm, 500 μm and 600 μm. A degree of foam and/or resistance to drainage, as discussed hereinbefore, can provide improved acceptance.

The dispenser can be an aerosol dispenser. Said aerosol dispenser, however, must comprise a container which can withstand acidic conditions. The dispenser must be capable of withstanding internal pressure in the range of from about 20 to about 130 p.s.i.g., more preferably from about 50 to about 125 p.s.i.g, and more preferably from about 100 to about 125 p.s.i.g. The aerosol dispenser utilizes a pressurized sealed container from which the acidic cleaning composition is dispensed through a special actuator/valve assembly under pressure. The aerosol dispenser is pressurized by incorporating therein a gaseous component generally known as a propellant. Common aerosol propellants, e.g., gaseous hydrocarbons such as isobutane, and mixed halogenated hydrocarbons, are not preferred. Halogenated hydrocarbon propellants such as chlorofluoro hydrocarbons have been alleged to contribute to environmental problems. Hydrocarbon propellants can be ignited. Preferred propellants are compressed air, nitrogen, inert gases, carbon dioxide, etc. A more complete description of commercially available aerosol-spray dispensers appears in U.S. Pat. No. 3,436,772, Stebbins, issued Apr. 8, 1969; and U.S. Pat. No. 3,600,325, Kaufman et al., issued Aug. 17, 1971; both of said references are incorporated herein by reference.

The dispenser can be a self-pressurized non-aerosol container having a convoluted liner and an elastomeric sleeve. Said self-pressurized dispenser comprises a liner/sleeve assembly containing a thin, flexible radially expandable convoluted plastic liner of from about 0.010 to about 0.020 inch thick, inside an essentially cylindrical elastomeric sleeve. The liner/sleeve is capable of holding a substantial quantity of odor-absorbing fluid product and of causing said product to be dispensed. A more complete description of self-pressurized spray dispensers can be found in U.S. Pat. No. 5,111,971, Winer, issued May 12, 1992, and U.S. Pat. No. 5,232,126, Winer, issued Aug. 3, 1993; both of said references are herein incorporated by reference. Another type of aerosol spray dispenser is one wherein a barrier separates the acidic cleaning composition from the propellant (preferably compressed air or nitrogen), as disclosed in U.S. Pat. No. 4,260,110, issued Apr. 7, 1981, and incorporated herein by reference. Such a dispenser is available from EP Spray Systems, East Hanover, N.J.

In one preferred embodiment, the dispenser is a non-aerosol, manually activated, pump-spray dispenser. Said pump-spray dispenser comprises a container and a pump mechanism which is secured to the container by screws, snaps, or in any other way, as known in the art. The container comprises a vessel for containing the acidic cleaning composition.

The pump mechanism comprises a pump chamber of substantially fixed volume, having an opening at the inner end thereof. Within the pump chamber is located a pump stem having a piston on the end thereof disposed for reciprocal motion in the pump chamber. The pump stem has a passageway there through with a dispensing outlet at the outer end of the passageway and an axial inlet port located inwardly thereof.

The container and the pump mechanism can be constructed of any conventional material employed in fabricating pump-spray dispensers, including, but not limited to: polyethylene; polypropylene; polyethyleneterephthalate; blends of polyethylene, vinyl acetate, and rubber elastomer. A preferred container is made of clear, e.g., polyethylene terephthalate. Other materials can include stainless steel that is resistant to acid and/or glass. A more complete disclosure of commercially available dispensing devices appears in: U.S. Pat. No. 4,895,279, Schultz, issued Jan. 23, 1990; U.S. Pat. No. 4,735,347, Schultz et al., issued Apr. 5, 1988; and U.S. Pat. No. 4,274,560, Carter, issued Jun. 23, 1981; all of said references are herein incorporated by reference.

In another preferred embodiment, the dispenser is a manually activated trigger-spray dispenser. Said trigger-spray dispenser comprises a container and a trigger both of which can be constructed of any of the conventional material employed in fabricating trigger-spray dispensers, including, but not limited to: polyethylene; polypropylene; polyacetal; polycarbonate; polyethyleneterephthalate; polyvinyl chloride; polystyrene; blends of polyethylene, vinyl acetate, and rubber elastomer. Other materials can include stainless steel that is resistant to attack by acid and/or glass. The trigger-spray dispenser does not incorporate a propellant gas into the odor-absorbing composition. The trigger-spray dispenser herein is typically one which acts upon a discrete amount of the acidic cleaning composition itself, typically by means of a piston or a collapsing bellows that displaces the composition through a nozzle to create a spray of thin liquid. Said trigger-spray dispenser typically comprises a pump chamber having either a piston or bellows which is movable through a limited stroke response to the trigger for varying the volume of said pump chamber. This pump chamber or bellows chamber collects and holds the product for dispensing. The trigger spray dispenser typically has an outlet check valve for blocking communication and flow of fluid through the nozzle and is responsive to the pressure inside the chamber. For the piston type trigger sprayers, as the trigger is compressed, it acts on the fluid in the chamber and the spring, increasing the pressure on the fluid. For the bellows spray dispenser, as the bellows is compressed, the pressure increases on the fluid. The increase in fluid pressure in either trigger spray dispenser acts to open the top outlet check valve. The top valve allows the product to be forced through the swirl chamber and out the nozzle to form a discharge pattern. An adjustable nozzle cap can be used to vary the pattern of the fluid dispensed.

For the piston spray dispenser, as the trigger is released, the spring acts on the piston to return it to its original position. For the bellows spray dispenser, the bellows acts as the spring to return to its original position. This action causes a vacuum in the chamber. The responding fluid acts to close the outlet valve while opening the inlet valve drawing product up to the chamber from the reservoir.

A more complete disclosure of commercially available dispensing devices appears in U.S. Pat. No. 4,082,223, Nozawa, issued Apr. 4, 1978; U.S. Pat. No. 4,161,288, McKinney, issued Jul. 17, 1985; U.S. Pat. No. 4,434,917, Saito et al., issued Mar. 6, 1984; and U.S. Pat. No. 4,819,835, Tasaki, issued Apr. 11, 1989; U.S. Pat. No. 5,303,867, Peterson, issued Apr. 19, 1994; all of said references being incorporated herein by reference.

A broad array of trigger sprayers or finger pump sprayers are suitable for use with the compositions of this invention. These are readily available from suppliers such as Calmar, Inc., City of Industry, Calif.; CSI (Continental Sprayers, Inc.), St. Peters, Mo.; Berry Plastics Corp., Evansville, Ind., a distributor of Guala® sprayers; or Seaquest Dispensing, Cary, Ill.

The preferred trigger sprayers are the blue inserted Guala® sprayer, available from Berry Plastics Corp., or the Calmar TS800-1A®, TS1300®, and TS-800-2®, available from Calmar Inc., because of the fine uniform spray characteristics, spray volume, and pattern size. More preferred are sprayers with precompression features and finer spray characteristics and even distribution, such as Yoshino sprayers from Japan. Any suitable bottle or container can be used with the trigger sprayer, the preferred bottle is a 17 fl-oz. bottle (about 500 ml) of good ergonomics similar in shape to the Cinch® bottle. It can be made of any materials such as high density polyethylene, polypropylene, polyvinyl chloride, polystyrene, polyethylene terephthalate, glass, or any other material that forms bottles. Preferably, it is made of high density polyethylene or clear polyethylene terephthalate.

For smaller fluid ounce sizes (such as 1 to 8 ounces), a finger pump can be used with canister or cylindrical bottle. The preferred pump for this application is the cylindrical Euromist II® from Seaquest Dispensing. More preferred are those with precompression features.

Pad

Figure 2:
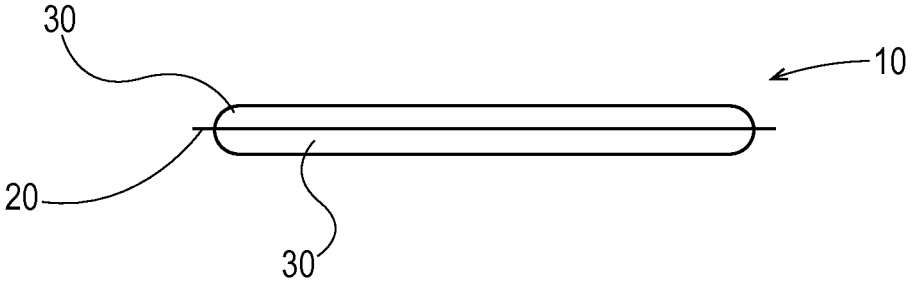
FIG. 2 is a side view of one embodiment of a pad of FIG. 1 having a core and two sheets.
Figure 3:
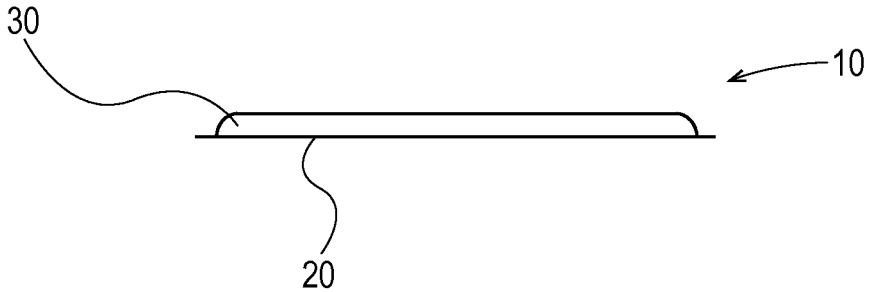
FIG. 3 is a side view of another embodiment of a pad of FIG. 1 having a core and one sheet.

The article of cleaning a hard surface herein also comprises a pad 10. Referring to FIGS. 1-3, the pad 10 used herein may comprise a core 20 and a sheet 30. The core 20 may be of any suitable shape, and particularly generally planar, and may include multiple layers. In one preferred embodiment, the core 20 may include from about 10 to about 2 layers. The core 20 may have at least one outwardly facing surface, suitable for cleaning, or otherwise treating the target surface. The outwardly facing surface may be covered with a sheet 30. The sheet 30 may be permeable to allow transmission of fluid therethrough.

The core 20 and sheet 30 may be joined together in the known fashion to provide a generally laminar structure. The core 20 and sheet 30 may be peripherally joined together at the edges, joined throughout, or provided in any other configuration which does not allow for unintended separation during use. Joining may be accomplished by adhesive, solvent welding, thermal bonding etc., as are known in the art. This arrangement provides the benefit that the pad 10 may be installed in the article and disposed of as a unitary assembly.

Generally, the core may comprise synthetic material, cellulosic material or combinations thereof. It will be understood that the material comprising the core may be a hydrophobic material, hydrophilic material, or combinations thereof. In one preferred embodiment, the core comprises up to about 50%, 40%, 30%, 20% and 10% cellulosic material. In one particularly preferred embodiment, the core is substantially free of cellulosic material. In yet another particularly preferred embodiment, the core is free of cellulosic material. It will be understood that the materials, as described herein for the core, are describing the material in contact with the composition. In other words, it will be understood that if a material is a fiber coated with a second material that is in contact with the cleaning composition, the description of the material herein describes the coating material.

Figure 8:
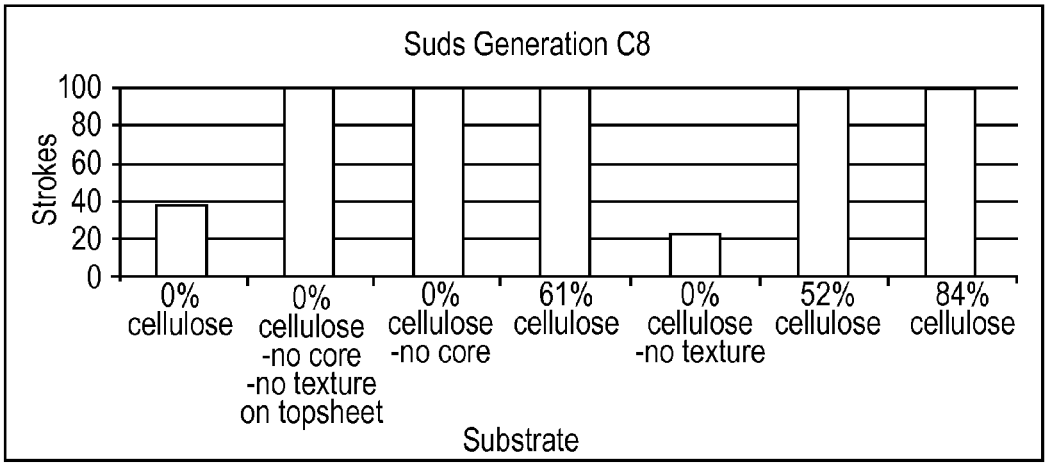
FIG. 8 is a graphical representation of suds generation, as measured by the number of strokes to generate suds when cleaning a tile using an automated laboratory device, of the article of the claimed invention using cleaning solutions having C8 carbon chain lengths.

Referring to the preferred embodiment described in FIG. 8, it shows the number of strokes to first generate suds on a test tile using the Suds Generation Value Test described in further detail herein were unexpectedly less when the core 20 was free of cellulosic material. Further, FIG. 8 also unexpectedly shows that the number of strokes to first generate suds using the Suds Generation Value Test did not decrease when the substrate was free of cellulosic material, but did not comprise a core. As such, without wishing to be bound by theory, it is believed that decreasing the level of cellulosic material in the core 20 increases the amount of suds generated when using the above described $C_8$ alkyl sulfate surfactant.

Figure 9:
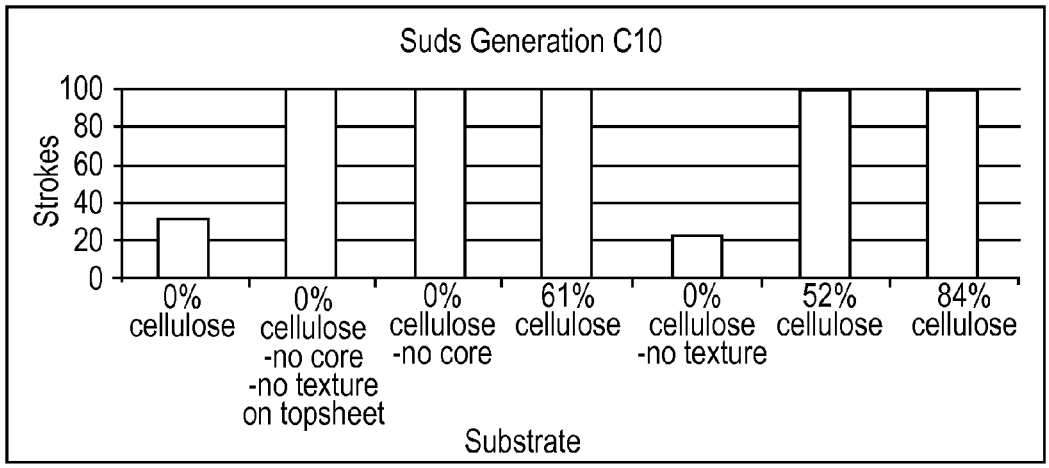
FIG. 9 is a graphical representation of suds generation, as measured by the number of strokes to generate suds when cleaning a tile using an automated laboratory device, of the article of the claimed invention using cleaning solutions having C10 carbon chain lengths.

Referring to the preferred embodiment described in FIG. 9, it shows the number of strokes to first generate suds on a test tile using the Suds Generation Value Test described in further detail herein were unexpectedly less when the core 20 was free of cellulosic material. Further, FIG. 9 also unexpectedly shows that the number of strokes to first generate suds using the Suds Generation Value Test did not decrease when the substrate was free of cellulosic material, but did not comprise a core. As such, without wishing to be bound by theory, it is believed that decreasing the level of cellulosic material in the core 20 increases the amount of suds generated when using the above described $C_{10}$ alkyl sulfate surfactant.

Figure 10:
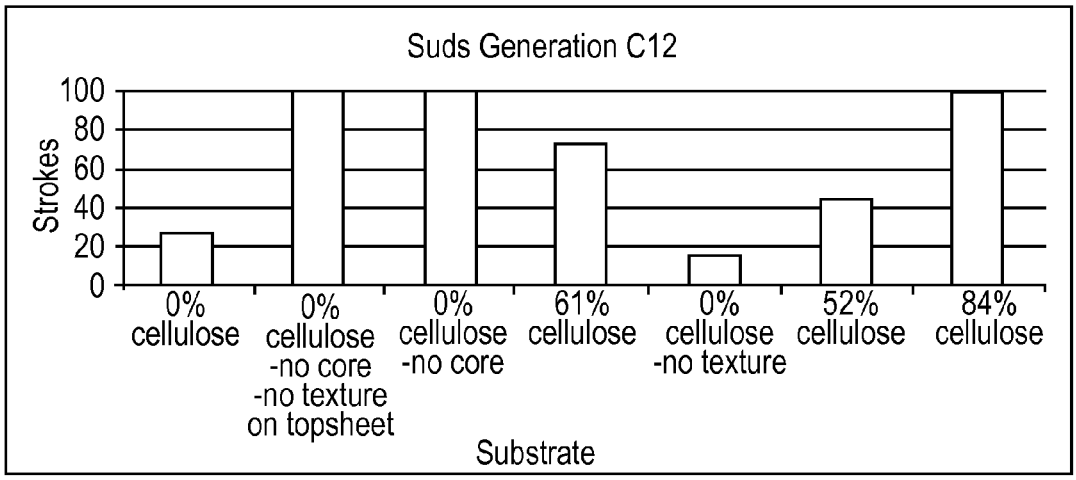
FIG. 10 is a graphical representation of suds generation, as measured by the number of strokes to generate suds when cleaning a tile using an automated laboratory device, of the article of the claimed invention using cleaning solutions having C12 carbon chain lengths.

Referring to the preferred embodiment described in FIG. 10, it shows the number of strokes to first generate suds on a test tile using the Suds Generation Value Test described in further detail herein were unexpectedly less when the core 20 comprised up to about 50% cellulosic material. Further, FIG. 10 also unexpectedly shows that the number of strokes to first generate suds using the Suds Generation Value Test did not decrease when the substrate comprised up to about 50% cellulosic material, but did not comprise a core. As such, without wishing to be bound by theory, it is believed that decreasing the level of cellulosic material in the core 20 increases the amount of suds generated when using the above described $C_{12}$ alkyl sulfate surfactant.

Figure 11:
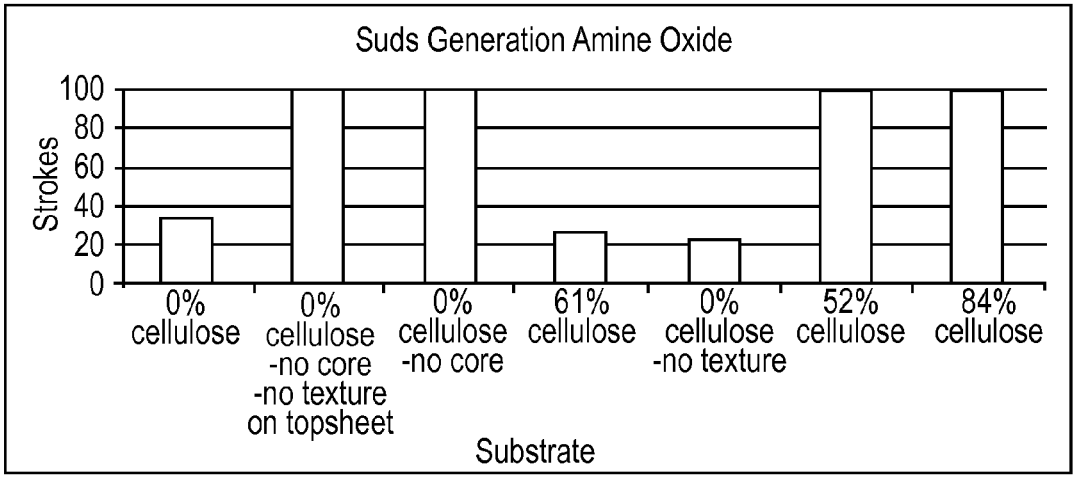
FIG. 11 is a graphical representation of suds generation, as measured by the number of strokes to generate suds when cleaning a tile using an automated laboratory device, of the article of the claimed invention using cleaning solutions having amine oxide.

Referring to the preferred embodiment described in FIG. 11, it shows the number of strokes to first generate suds on a test tile using the Suds Generation Value Test described in further detail herein were unexpectedly less when the core 20 was free of cellulosic material. Further, FIG. 11 also unexpectedly shows that the number of strokes to first generate suds using the Suds Generation Value Test did not decrease when the substrate was free of cellulosic material, but did not comprise a core. As such, without wishing to be bound by theory, it is believed that decreasing the level of cellulosic material in the core 20 increases the amount of suds generated when using the above described amine oxide surfactant.

One suitable core 20 may comprise polyurethane foam, natural or synthetic sponge, and combinations thereof. The core 20 may also, alternatively, comprise melamine foam as is sold by the instant assignee under the name Mr. Clean Eraser®. The core 20 may comprise melamine foam, as set forth in U.S. Pat. No. 7,629,043 or in commonly assigned 2009/172828 A1, now abandoned.

The core 20 may be generally planar and have an outwardly facing surface for contacting a hard surface and removing debris therefrom. The core may further absorb the cleaning composition sprayed onto or otherwise disposed on the hard surface.

If desired, the core 20 may be impregnated with the cleaning composition. The cleaning composition may be complementary to or the same as the cleaning composition sprayed from the dispenser, as described in detail above.

If desired, the core 20 may be replaceable and may optionally be covered with any suitable sheet 30, such as a nonwoven, the nonwoven optionally being textured, including nonwoven synthetic fibers, microfiber nonwoven, a textured polyolefinic film and combinations thereof. In one embodiment, the sheet 30 may be comprised of a hydrophilic material. A nonwoven synthetic fabric may include polyethylene terephthalate ("PET") fibers with a 2.52 dtex and 46 gsm basis weight. Alternatively, a microfiber nonwoven may have a basis weight of 15 to 100 gsm, 60 to 90 gsm or 80 gsm. A microfiber nonwoven may comprise PET/Nylon, PE/PP, etc., as is known in the art.

As shown in FIG. 3, the sheet 30 may be disposed only on the outwardly facing surface of the sheet 30 or, alternatively, as shown in FIG. 2, may cover the outwardly facing surface and the surface opposed thereto so that when the first surface becomes soiled, the pad 10 may simply be inverted/reattached for continued cleaning.

When the pad 10 becomes too soiled for efficacious cleaning, it may simply be removed from the article and discarded. A new efficacious pad may then be attached to the device and deployed for cleaning.

For example, a core 20 comprising polyurethane foam and a 60 gsm nonwoven microfiber may provide cleaning efficacy due to the polyurethane foam absorbing and reapplying the cleaning composition while the microfiber nonwoven traps debris. By absorbing and reapplying the cleaning composition during the cleaning process, less cleanser needs to be utilized, providing savings in use.

Figure 6:
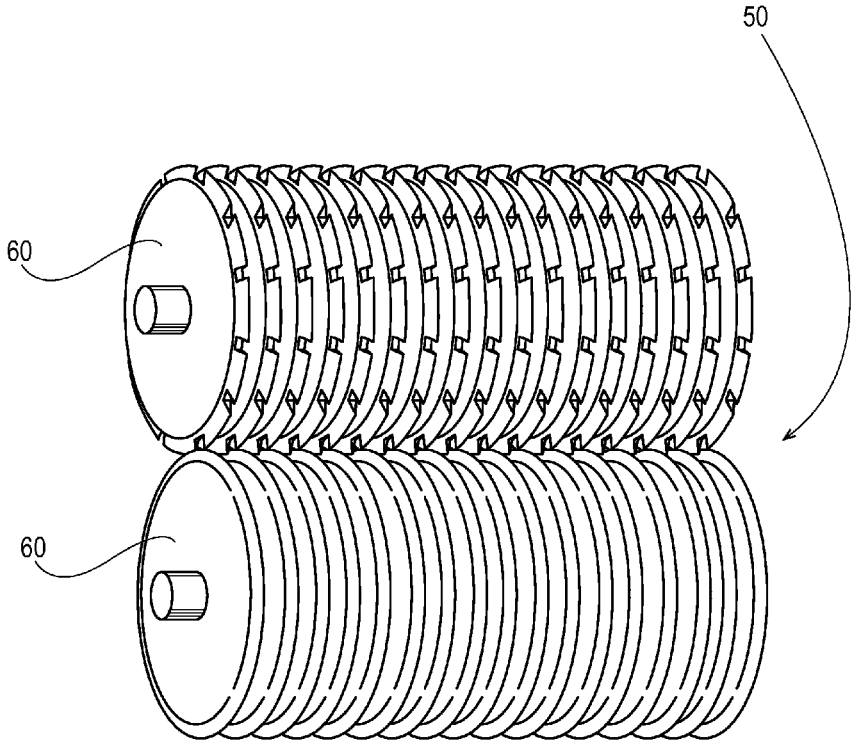
FIG. 6 is a simplified illustration of an apparatus used to form pads of the present invention.
Figure 7:
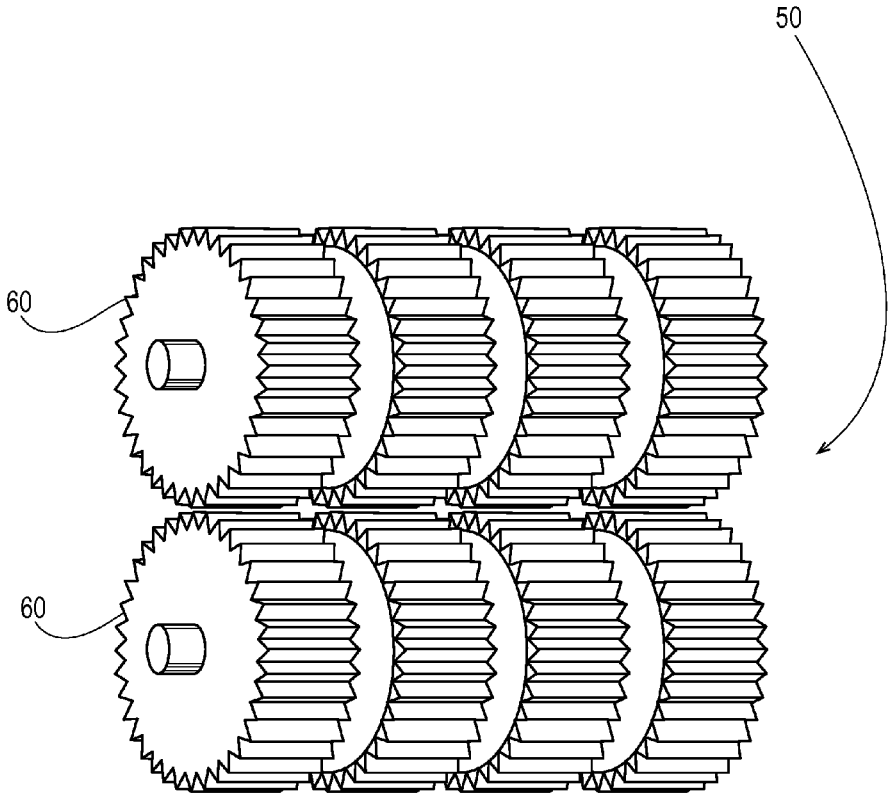
FIG. 7 is a simplified illustration of another apparatus used to form pads of the present invention.

The sheet 30 used herein may be formed from a generally planar, two dimensional nonwoven precursor web using apparatus 50 as shown in FIGS. 6 and 7. The apparatus 50 may be oriented for continuous web processing with respect to a machine direction (MD) and having a cross machine direction (CD) as is commonly known in the art of nonwoven webs.

Referring to FIGS. 6-7, the apparatus 50 may comprise a pair of rolls 60, each rotating about parallel axes. The apparatus may comprise a pattern roll and a bed roll. Such an apparatus may be similar to the apparatuses described in commonly assigned U.S. Pat. Nos. 5,916,661; 5,628,097 and 5,518,801 issued to Chappell et al. and U.S. 2004/0127875 published in the name of Hammons et al.

The apparatus may comprise a roll 60 having a plurality of circumferentially extending ridges separated by grooves, as disclosed in these patents and known in the art as ring-rolling. One roll of this apparatus, the pattern roll, may have toothed ridges separated by grooves. The ridges of the pattern roll mesh with the grooves of the facing roll to form the protrusions on the sheet.

If a single pattern roll and a single bed roll are used, the pattern roll may provide a depth of engagement ranging from 3.1 to 3.5 mm, particularly 3.2 to 3.4 mm, and a single pattern roll/bed roll apparatus may run at a speed ranging from 500 to 1000 m per minute and may particularly be 260 meters per minute.

Figure 4:
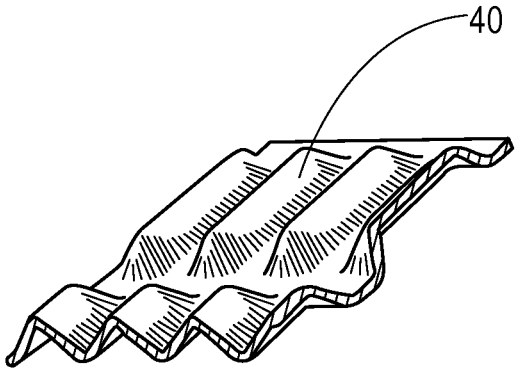
FIG. 4 is a segmented perspective view of one embodiment of a pad of FIG. 1 having protrusions.
Figure 5:
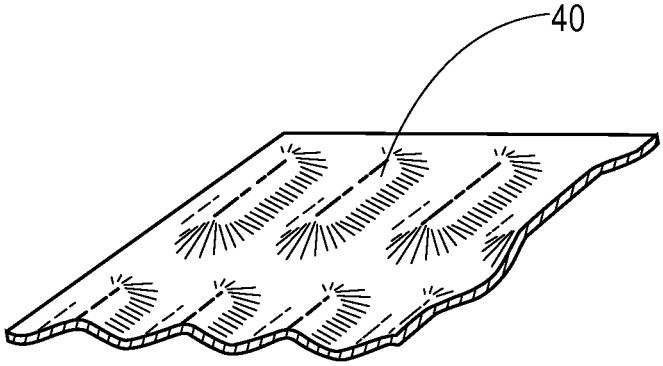
FIG. 5 is a segmented perspective view of another embodiment of a pad of FIG. 1 having protrusions.

If desired, the apparatus may comprise a single bed roll with a plurality of pattern rolls circumferentially spaced there around. Each pattern roll may provide successively deeper engagement between the ridges of that pattern roll and the bed roll. By deforming the protrusions of the sheet in plural steps, rather than in a single step, it is believed that the protrusions have improved resiliency. The improved resiliency may contribute to improve cleaning. In one exemplary embodiment the pattern rolls may provide a depth of engagement of 1.9, 2.0 and 3.2 mm, respectively, and may run at a line speed ranging from 120 to 250 meter per minute. Referring now to FIGS. 4 and 5, the protrusions 40 of the sheet 30 may have a length in the machine direction ranging from 5 to 7 mm. The protrusions 40 may be spaced on a pitch ranging from 1.5 to 5 mm, and particularly 4 mm, in the cross machine direction. The protrusions 40 maybe spaced on a pitch ranging from 4 to 15 mm, and particularly 12 mm, in the machine direction. The protrusions 40 may or may not pierce the sheet to form an apertured or non-apertured scrubbing surface, as desired.

One advantage of the apparatus described above is that the pad 10 can be produced in-line with other production equipment on a manufacturing line for producing such articles. For example, an apparatus such as disclosed above, can be made as a unit operation for an existing manufacturing line. As a unit operation, such apparatus can be modular, so that it can be easily changed out. When used as part of a manufacturing line for cleaning pads 10, the constituent rolls 60 need not be much wider than the product itself, thereby providing for relatively easy installation and removal. Various patterns can therefore be implemented with a minimum interruption.

Use

The article herein comprises a cleaning composition and a pad and is used to clean a hard surface. In one embodiment, the article may also comprise a dispenser. In the method of use Suds Generation Value Test Method Generally, the Suds Generation Value Test measures the ability of the substrate or scrubbing device to generate suds during interaction with a standard cleaning fluid.

The test is conducted using the Model 903PG Washability Tester, a specific Wet Abrasion Scrub Tester Machine, from Sheen Instruments Limited, Surrey, England. This is a straight-line, reciprocating washability testing machine, having four cleaning tracks and four scrub heads which hold the substrates or scrubbing devices to be tested. The substrate clamping frame is capable of holding samples from 10 mm×135 mm in size up to 320 mm×470 mm in size, and up to 30 mm thick. If the dimensions of the device to be tested are too large to fit in the clamping frame, then the device may be cut down in order to fit. When testing a substrate, load a sample with dimensions of 110 mm×45 mm into the clamping frame. Scrubbing devices or substrates are dry when loaded into the clamp, and the only source of moisture during the tests is the undiluted cleaning fluid. Note that the counter on the washability tester counts 1 for every two strokes. One stroke is defined when the head has moved across the surface twice and returned back to its starting position. For this test method, the machine counter is stopped at a maximum of 50 counts, which equals 100 strokes.

First, the washability tester is configured with: a weight of 600 g loaded onto each scrub head; a stroke length of 36 cm; a travel speed of 20 rpm; and apply by hand in a zig zag motion a 4 mL dose of cleaning fluid evenly across the scrubbing surface of the substrate or device, immediately prior to commencing the first scrubbing pass.

A clean, standard ceramic tile as defined below is placed in the machine along with the substrate or scrubbing device to be tested. The standard ceramic tile is defined as being: 30 cm×30 cm in size, black in colour, gloss surface, Series name "Retro—high density ceramic floor tile", from Interceramic Inc., Garland, Tex., USA.

The Suds Generation Value of the test substrate is defined as the minimum number of scrubbing strokes required to generate a continuous, unbroken line of suds. Substrates which generate the continuous line of suds with fewer strokes are deemed to be better at suds generation. The degree of suds generation is continuously evaluated by the operator while the washability tester scrubs the tile and counts its strokes. The scrubbing continues until at least one solid, continuous line of suds is observed across the tile near the edge of the substrate's path, and this line of suds spans the full length of the stroke length, and does not collapse or break with each pass of the scrubbing head. When such a line of suds is generated, the operator records for that substrate the number of strokes which have been applied up to that point. Those substrates which do not create a continuous line of suds after 100 strokes are recorded as having a suds generation value of >100 strokes.

For each substrate being tested, conduct at least three replicate Suds Generation Value measurements and average those results together.

Spray Device Conditions for Test Methods

When a cleaning composition to be tested is accompanied with an article comprising a spraying device, then that accompanying device is used to spray the composition for the purposes of testing to determine the particle size distribution and the suds dissolution rate. When a cleaning composition to be tested is not accompanied by an article comprising a spraying device, then the spray device and conditions described below are used for testing to determine the composition's particle size distribution and suds dissolution rate.

Cleaning compositions which are unaccompanied by a spray device are to be loaded into an aerosol can spray device comprising a bag-on-valve connected to a plastic cup-fitting vertical actuator, having a mechanical breakup insert (MBU). The MBU has a circular swirl chamber, and a straight-sided exit orifice (i.e., straight taper) with an internal diameter of 0.33 mm+/−0.02. The spray device uses compressed nitrogen gas propellant, and is pressurized to 827 kPa+/−55 (i.e., 120 Psi+/−8), delivering an initial flow rate of approximately 1.1 g/sec. A suitable device may utilize the Vulkan actuator CS21-2941-05 (available from Precision Valve Corporation, Rye Brook, N.Y., USA), in combination with the bag-on-valve 6601/D4 having a 4.0 mm×3.8 mm fast fill stem (available from Aptar Cary a division of Aptar Group Inc., Crystal Lake, Ill., USA). Note that the nitrogen gas propellant is not in physical contact with the cleaning composition.

Particle Size Distribution Test Method

The distribution of volume-weighted particle size diameters in the sprayed cleaning composition is determined via laser light scattering, using a Spraytec 2000 particle size analyzer and Malvern RT Sizer 3.03 software. Both are available from Malvern Instruments Ltd. Worcestershire, UK.

A 300 mm focal length lens is used, having minimum and maximum particle size detection limits of 0.1 μm and 900 μm, respectively. The spray nozzle is positioned 15 cm (i.e., 6 inches) from the laser beam, using a 100 mm path length. A particulate refractive index of 1.33 and a dispersant refractive index of 1.00 are selected. A Residual of 0.41 is selected, with the Extinction Analysis set to the Off position, and the Multiple Scatter option set to the On position. The Scatter Start is set to 1, Scatter End is set to 36, and Scattering Threshold is set to 1.

A sample is then sprayed into the laser beam manually by pressing down the spray actuator, while data on the particle size distribution of the spray droplets are recorded by the instrument.

One of skill will consider the distribution's Dv50 measurement, meaning that 50 percent of the particles in the volume-weighted size distribution have a particle diameter less than the value indicated. The Dv50 measurement is also known as the median particle size by volume.

The test is run in triplicate for each composition, in a room having a temperature of 20-25° C. and a relative humidity of 40-60% RH, while being protected from air currents. The Particle Size Distribution value reported for a composition is the average Dv50 measurement from the three replicate samples tested.

Referring now to the formulations described in FIG. 12, it shows the dissolution of the formulations detailed below dispensed via an aerosol device using the Particle Size Distribution Test Method described above were unexpectedly desirable in producing foam when the particle size was above 200 μm. Indeed, in one preferred embodiment, it was found that foam was not produced via an aerosol device unless the particle size was above 200 μm using the herein described Particle Size Distribution Test Method.

Figure 12:
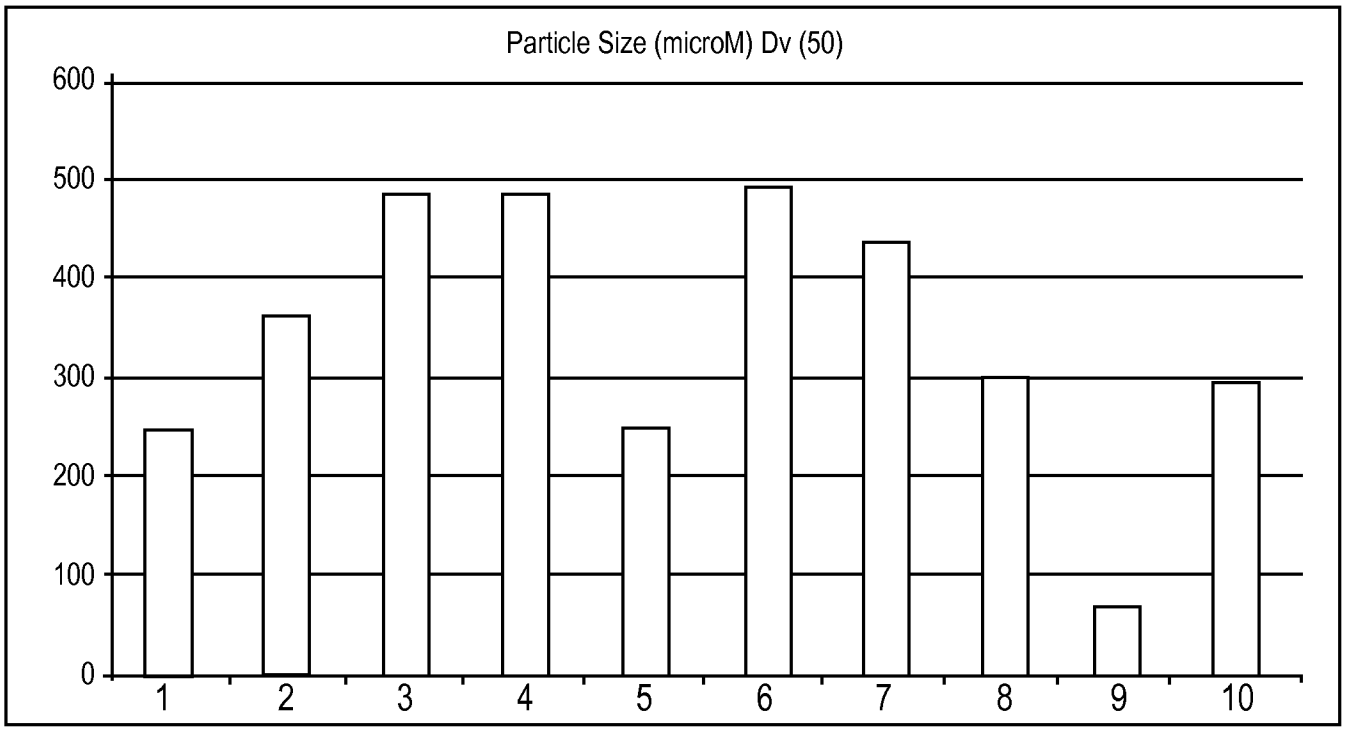
FIG. 12 is a graphical representation of particle size distribution, as measured by the Particle Size Distribution Test Method, using cleaning solutions of the claimed invention via an aerosol device.

Specifically, the formulations described in FIG. 12 are:

Formulation 1: 4.00% Na $C_8$ alkyl sulfate, 4.50% Citric Acid, 2.14% NaOH, 0.12% Perfume and Balance Water.

Formulation 2: 4.00% Na $C_8$ alkyl sulfate, 4.50% Citric Acid, 4.00% Dipropylene Glycol n-Butyl Ether 2.14%, NaOH 0.10% Polyvinyl pyrrolidone, 0.12%, Perfume and Balance Water.

Formulation 3: 4.00% Na $C_8$ alkyl sulfate, 4.50% Citric Acid, 4.00% Dipropylene Glycol n-Butyl Ether, 2.14% NaOH, 0.075% Xanthan gum, 0.12% Perfume and Balance Water.

Formulation 4: 4.00% Na $C_8$ alkyl sulfate, 4.50% Citric Acid, 4.00% Dipropylene Glycol n-Butyl Ether, 2.14% NaOH, 0.10% Polyvinyl pyrrolidone, 0.075% Xanthan gum, 0.12% Perfume and Balance Water.

Formulation 5: 4.00% Na $C_{1-2}$ alkyl sulfate, 4.50% Citric Acid, 4.00% Dipropylene Glycol n-Butyl Ether, 2.14% NaOH, 0.10% Polyvinyl pyrrolidone 0.075% Xanthan gum, 0.12% Perfume, 0.05% Dow Corning DC 1410 (GCAS: 10051407), Balance Water.

Formulation 6: 4.00% Na $C_8$ alkyl sulfate, 4.50% Citric Acid, 4.00% NaOH, 0.10% Polyvinyl pyrrolidone, 0.075% Xanthan gum, 0.12% Perfume and Balance Water.

Formulation 7: 4.00% Na $C_8$ alkyl sulfate, 4.50% Citric Acid, 4.00% NaOH, 0.075% Xanthan gum, 0.12% Perfume and Balance Water.

Formulation 8: 4.00% Na $C_{1-2}$ alkyl sulfate, 4.50% Citric Acid, 4.00% Dipropylene Glycol n-Butyl Ether, 2.14% NaOH, 0.10% Polyvinyl pyrrolidone, 0.075% Xanthan gum, 0.1% Dow Corning DC 1410 (GCAS: 10051407), 0.12% Perfume and Balance Water.

Formulation 9: 4.00% Alcohol ethoxylate (Bio-Soft N1-9), 4.50% Citric Acid, 4.00% Dipropylene Glycol n-Butyl Ether, 2.14% NaOH, 0.10% Polyvinyl pyrrolidone, 0.075% Xanthan gum, 0.12% Perfume and Balance Water.

Formulation 10: 4.00% Cocamidopropyl 2-Hydroxypropyl sultaine (Mackam 50 SB), 4.50% Citric Acid, 4.00% Dipropylene Glycol n-Butyl Ether, 2.14% NaOH, 0.10% Polyvinyl pyrrolidone, 0.075% Xanthan gum, 0.12% Perfume and Balance Water.

Suds Dissolution Rate Test Method

Cleaning compositions are visually evaluated to determine the dissolution rate of the suds generated (i.e., the time it takes for the suds to collapse). The composition is sprayed at a ~270° angle directly onto the wall of a 250 mL glass beaker (to prevent the pressure of the sprayer from collapsing the existing suds) until 200 mL of suds have accumulated in the beaker. A timer is then immediately turned on and the beaker is observed in order to record the time it takes for the suds to collapse at 50 mL intervals (i.e., record the time taken to collapse to 150 mL, to 100 mL, and to 50 mL). The recorded data points are plotted on a graph of "Time in Seconds vs. Volume in mL". The slope of the linear trend line through the data points is calculated for each sample, and indicates its Suds Dissolution Rate. In this case $y=mx+b$, where m equals the dissolution rate of the composition. The test is run in triplicate for each composition, in a room having an air temperature of 20-25° C. and a relative humidity of 40-60% RH, while being protected from air currents. The reported Suds Dissolution Rate of a composition is the average value from the three replicate samples tested.

Referring now to the preferred embodiment described in FIG. 13, it shows the dissolution of the above described compositions using the Suds Dissolution Rate Test described above were unexpectedly desirable when the rate was above 0.8 ml/s. In one preferred embodiment of the present invention, the cleaning composition has a Suds Dissolution Rate from about 0.5 ml/s to about 3.0 ml/s, from about 0.6 ml/s to about 2.6 ml/s and from about 0.8 ml/s to about 1.5 ml/s. In another preferred embodiment of the present invention, the cleaning composition has a Suds Dissolution Rate greater than about 0.5 ml/s, about 0.6 ml/s, about 0.8 ml/s and about 1.2 ml/s.

Specifically, the formulations described in FIG. 13 are:

Formulation 1: 4.00% Na $C_8$ alkyl sulfate, 4.50% Citric Acid, 2.14% NaOH, 0.10% Polyvinyl pyrrolidone, 0.075% Xanthan gum, 0.12% Perfume and Balance Water.

Formulation 2: 4.00% Na $C_8$ alkyl sulfate, 4.50% Citric Acid, 2.14% NaOH, 0.075% Xanthan gum, 0.12% Perfume and Balance Water.

Formulation 3: 4.00% Na $C_8$ alkyl sulfate, 4.50% Citric Acid, 4.00% Dipropylene Glycol n-Butyl Ether, 2.14% NaOH, 0.10% Polyvinyl pyrrolidone, 0.12% Perfume and Balance Water.

Formulation 4: 4.00% Na $C_8$ alkyl sulfate, 4.50% Citric Acid, 4.00% Dipropylene Glycol n-Butyl Ether, 2.14% NaOH, 0.10% Polyvinyl pyrrolidone, 0.075% Xanthan gum, 0.12% Perfume and Balance Water.

Formulation 5: 4.00% Na $C_8$ alkyl sulfate, 4.50% Citric Acid, 4.00% Dipropylene Glycol n-Butyl Ether, 2.14% NaOH, 0.075% Xanthan gum, 0.12% Perfume and Balance Water.

Formulation 6: 4.00% Na $C_{10}$ alkyl sulfate, 4.50% Citric Acid, 4.00% Dipropylene Glycol n-Butyl Ether, 2.14% NaOH, 0.10% Polyvinyl pyrrolidone, 0.075% Xanthan gum, 0.12% Perfume and Balance Water.

Formulation 7: Scrubbing Bubbles.

Formulation 8: 4.00% Amine Oxide, 4.50% Citric Acid, 4.00% Dipropylene Glycol n-Butyl Ether, 2.14% NaOH, 0.10% Polyvinyl pyrrolidone, 0.075% Xanthan gum, 0.12% Perfume and Balance Water.

Formulation 9: Lysol.

Formulation 10 4.00% Na $C_{1-2}$ alkyl sulfate, 4.50% Citric Acid, 4.00% Dipropylene Glycol n-Butyl Ether, 2.14% NaOH, 0.10% Polyvinyl pyrrolidone, 0.075% Xanthan gum, 0.12% Perfume and Balance Water.

EXAMPLES

The present invention is further illustrated by the following examples.

| Ingredient | Wt % | Wt % | Wt % | Wt % | Wt % | Wt % | Wt % |
|---|---|---|---|---|---|---|---|
| Na $C_8$ alkyl sulfate | 4.00 | 3.00 | 3.00 | 3.00 | 4.00 | 3.00 | 4.00 |
| Na $C_{12}$ alkyl sulfate | | | | 2.00 | | | |
| Cocoamidopropyl Betaine | | 2.00 | | | | | |
| Cocoamidopropyl Sultaine | | | 2.00 | | | | |
| Alkylamine oxide | | | | | | 2.00 | 1.00 |
| Citric acid | 4.50 | 4.50 | 4.50 | 4.50 | 4.50 | 4.50 | 4.50 |
| Dipropylene Glycol n-Butyl Ether | 4.00 | 4.00 | 4.00 | 4.00 | 4.00 | 4.00 | 4.00 |
| Sodium Hydroxide | 2.14 | 2.14 | 2.14 | 2.14 | 2.14 | 2.14 | 2.14 |
| Xanthan gum | 0.075 | 0.075 | 0.075 | 0.075 | 0.15 | 0.15 | 0.15 |
| Polyvinyl pyrrolidone | 0.10 | 0.20 | 0.20 | 0.20 | 0.20 | 0.20 | 0.20 |
| Perfume | 0.12 | 0.12 | 0.12 | 0.12 | 0.12 | 0.12 | 0.12 |
| Water | Bal. | Bal. | Bal. | Bal. | Bal. | Bal. | Bal. |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An article for cleaning debris from a hard surface, said article comprising:

a) a hard surface cleaning composition which comprises from about 0.1% to about 50% by weight of the composition of a surfactant wherein the surfactant is an alkyl sulfate detergent surfactant, the alkyl group of the alkyl sulfate detergent surfactant contains 8 carbon atoms on the average with substantially all of the alkyl groups having within two carbon atoms of the 8 average carbon atoms, wherein the cleaning composition does not include an alkyl sulfate detergent surfactant that contains about 10 carbon atoms on the average, with substantially all of the alkyl groups having within two carbon atoms of the 10 average carbon atoms, wherein the cleaning composition has a suds dissolution rate from about 0.8 ml/s to about 2.6 ml/s using the Suds Dissolution Rate Test and b) a pad comprising a core and adapted to contact the hard surface, the core comprising up to about 50% cellulosic material.

2. An article according to claim 1, wherein the core comprises up to about 30% cellulosic material.

3. An article according to claim 1, wherein the core is free of cellulosic material.

4. An article according to claim 1, wherein suds are generated in under about 50 strokes using the Suds Generation Value Test.

5. An article according to claim 1, wherein the cleaning composition has a particle size distribution at Dv50 of at least about 200 μm using the Particle Size Distribution Test Method.

6. An article according to claim 1, further comprising from about 0.25% to about 4% by weight of the composition of an anionic cosurfactant selected from the group consisting of: $C_{12}$-$C_{18}$ paraffin sulfonates, $C_8$-$C_{18}$ alkyl ethoxy sulfates; $C_8$-$C_{18}$ alkyl sulfates, and mixtures thereof.

7. An article, for cleaning debris from a hard surface, said article comprising:

a) a hard surface cleaning composition which comprises from about 0.1% to about 50% by weight of the composition of a surfactant wherein the surfactant is an alkyl sulfate detergent surfactant, the alkyl group of the alkyl sulfate detergent surfactant contains 8 carbon atoms on the average with substantially all of the alkyl groups having within two carbon atoms of the 8 average carbon atoms, wherein the cleaning composition does not include an alkyl sulfate detergent surfactant that contains about 10 carbon atoms on the average, with substantially all of the alkyl groups having within two carbon atoms of the 10 average carbon atoms, wherein the composition further comprises from about 0.001% to about 0.3% by weight of the composition of a hydrophilic polymer selected from the group consisting of: polystyrene sulfonate; polyvinylpyrrolidone; polyvinyl pyrrolidone/acrylate copolymer; polyvinyl pyridine; polyvinyl pyridine n-oxide; and mixtures thereof, wherein the cleaning composition has a suds dissolution rate from about 0.8 ml/s to about 2.6 ml/s using the Suds Dissolution Rate Test; and b) a pad comprising a core and adapted to contact the hard surface, the core comprising up to about 50% cellulosic material.

8. An article according to claim 1, comprising from about 1% to about 10% by weight of the composition of said alkyl sulfate surfactant; from about 1% to about 6% by weight of the composition of one, or more, organic cleaning solvents; from about 2% to about 6% by weight of the composition of organic acid; from about 60% to about 90% by weight of the composition of an aqueous solvent system, said composition having a pH of about 3 to about 7.

9. An article according to claim 1, further comprising an organic cleaning solvent selected from the group consisting of dipropylene glycol n-butyl ether, butoxy propanol and propoxy propanol.

10. An article according to claim 1, further comprising a polycarboxylic acid selected from the group consisting of: citric acid and mixtures of succinic, adipic, glycolic, and glutaric acids, and mixtures thereof.

11. An article according to claim 1, further comprising a dispenser containing the cleaning composition, wherein the dispenser comprises a trigger spray device or an aerosol device.

12. An article according to claim 11 wherein the dispenser is an aerosol device and is capable of providing droplets with a particle size distribution at Dv50 of at least about 200 μm using the Particle Size Distribution Test Method.

13. An article according to claim 1 wherein the cleaning composition has a pH under usage conditions of from about 2 to about 7.

14. A kit for cleaning a hard surface, comprising the article according to claim 1.

15. A process of cleaning a surface comprising:

applying an effective amount of a cleaning composition according to claim 1 to the surface and wiping the surface with a pad comprising a core and adapted to contact the hard surface, the core comprising up to about 50% cellulosic material.

16. The process of claim 15 wherein the effective amount is applied onto said surface using a trigger-spray device or an aerosol device.

* * * * *